US009993688B2

(12) United States Patent
Siegel

(10) Patent No.: US 9,993,688 B2
(45) Date of Patent: Jun. 12, 2018

(54) DEVICE AND METHOD FOR SENSING, GUIDING, AND/OR TRACKING PELVIC EXERCISE

(71) Applicant: Skye Health, Inc., New York, NY (US)

(72) Inventor: Adam Carlyn Siegel, New York, NY (US)

(73) Assignee: Skye Health, Inc., New York, NY (US)

( * ) Notice: Subject to any disclaimer, the term of this patent is extended or adjusted under 35 U.S.C. 154(b) by 0 days. days.

(21) Appl. No.: 14/594,749

(22) Filed: Jan. 12, 2015

(65) Prior Publication Data

US 2015/0196802 A1 Jul. 16, 2015

Related U.S. Application Data

(60) Provisional application No. 62/100,467, filed on Jan. 6, 2015, provisional application No. 62/023,196, filed (Continued)

(51) Int. Cl.
*A63B 71/00* (2006.01)
*A63B 24/00* (2006.01)

(Continued)

(52) U.S. Cl.
CPC ..... *A63B 24/0062* (2013.01); *A63B 21/008* (2013.01); *A63B 21/0023* (2013.01);

(Continued)

(58) Field of Classification Search
CPC ..... A63B 21/00189; A63B 21/0023; A63B 21/008; A63B 21/0085; A63B 21/028; A63B 23/20; A63B 24/0062; A63B 2024/0068; A63B 71/0619; A63B 71/0622; A63B 2071/0625; A63B 2071/0655;

(Continued)

(56) References Cited

U.S. PATENT DOCUMENTS 3,752,150 A * 8/1973 Harris ..... A61B 5/202 600/38
4,216,783 A * 8/1980 Kaiser ..... A61B 5/202 600/561

(Continued)

FOREIGN PATENT DOCUMENTS

EP 2 708 187 A1 3/2014
WO WO 2012/016005 A2 2/2012

(Continued)

OTHER PUBLICATIONS

U.S. Appl. No. 14/800,093, filed Jul. 15, 2015, Siegel.

(Continued)

*Primary Examiner* — Joshua Lee
(74) *Attorney, Agent, or Firm* — Wolf, Greenfield & Sacks, P.C.

(57) ABSTRACT

Devices such as medical devices, including those for use in conducting pelvic muscle exercise, are generally provided. Embodiments herein relate generally to the medical device and consumer medical product fields, and in some embodiments, to a device for sensing, guiding, and/or tracking pelvic muscle exercise in men and women for the purpose of treating urinary incontinence, sexual dysfunction, and other pelvic conditions.

33 Claims, 18 Drawing Sheets

Related U.S. Application Data on Jul. 11, 2014, provisional application No. 61/926,407, filed on Jan. 13, 2014.

(51) Int. Cl.

| | |
|---|---|
| ***A63B 21/008*** | (2006.01) |
| ***A63B 21/00*** | (2006.01) |
| ***A63B 71/06*** | (2006.01) |
| ***A63B 21/002*** | (2006.01) |
| ***A63B 21/02*** | (2006.01) |
| ***A63B 23/20*** | (2006.01) |

(52) U.S. Cl.

CPC .... *A63B 21/0085* (2013.01); *A63B 21/00189* (2013.01); *A63B 21/028* (2013.01); *A63B 23/20* (2013.01); *A63B 71/0619* (2013.01); *A63B 71/0622* (2013.01); *A63B 2024/0068* (2013.01); *A63B 2071/0625* (2013.01); *A63B 2071/0655* (2013.01); *A63B 2220/13* (2013.01); *A63B 2220/51* (2013.01); *A63B 2220/56* (2013.01); *A63B 2220/64* (2013.01); *A63B 2220/801* (2013.01); *A63B 2220/803* (2013.01); *A63B 2220/833* (2013.01); *A63B 2225/50* (2013.01)

(58) Field of Classification Search

CPC ..... A63B 2220/51; A63B 2220/56; A63B 2220/64; A63B 2220/801; A63B 2220/803; A63B 2220/833; A63B 2225/50; A61B 5/227

USPC ..... 482/1, 8; 600/591

See application file for complete search history.

(56) References Cited

U.S. PATENT DOCUMENTS

| | | | | |
|---|---|---|---|---|
| 5,483,832 | A | 1/1996 | Pauser et al. | |
| 5,800,501 | A * | 9/1998 | Sherlock | A61N 1/0512 600/373 |
| 6,063,045 | A | 5/2000 | Wax et al. | |
| 6,217,529 | B1 | 4/2001 | Wax et al. | |
| 6,264,582 | B1 | 7/2001 | Remes | |
| 6,468,232 | B1 | 10/2002 | Ashton-Miller et al. | |
| 6,905,471 | B2 | 6/2005 | Leivseth et al. | |
| 7,473,214 | B2 | 1/2009 | Schuurmans et al. | |
| 7,645,220 | B2 | 1/2010 | Hoffman et al. | |
| 7,955,241 | B2 | 6/2011 | Hoffman et al. | |
| 7,957,794 | B2 | 6/2011 | Hochman et al. | |
| 8,509,900 | B2 * | 8/2013 | Boyd | A61N 1/0512 607/41 |
| 2003/0220589 | A1 * | 11/2003 | Leivseth | A61B 5/227 600/591 |
| 2004/0122341 | A1 * | 6/2004 | Walsh | A61B 5/227 600/591 |
| 2006/0036188 | A1 * | 2/2006 | Hoffman | A61B 5/0002 600/591 |
| 2008/0139876 | A1 * | 6/2008 | Kim | A61B 5/202 600/29 |
| 2009/0270963 | A1 | 10/2009 | Pelger et al. | |
| 2009/0281397 | A1 * | 11/2009 | Lavoisier | A61B 5/227 600/301 |
| 2010/0035727 | A1 | 2/2010 | Brunner | |
| 2010/0222708 | A1 | 9/2010 | Hitchcock et al. | |
| 2013/0000543 | A1 | 1/2013 | Terao et al. | |
| 2013/0130871 | A1 | 5/2013 | McCoy et al. | |
| 2014/0058288 | A1 * | 2/2014 | Bartol | A61B 5/6867 600/595 |
| 2014/0066813 | A1 * | 3/2014 | Daly | A63B 23/20 600/591 |
| 2014/0088471 | A1 * | 3/2014 | Leivseth | A63B 23/20 601/89 |
| 2014/0128777 | A1 * | 5/2014 | Ai | A61B 5/103 600/587 |
| 2014/0155225 | A1 * | 6/2014 | Sedic | A61N 1/36007 482/9 |
| 2015/0273270 | A1 * | 10/2015 | Brinkhaus | A63B 23/20 482/8 |
| 2016/0008664 | A1 | 1/2016 | Siegel | |
| 2016/0029944 | A1 * | 2/2016 | Galliano | A63B 23/20 600/587 |

FOREIGN PATENT DOCUMENTS

| | | | |
|---|---|---|---|
| WO | WO 2012/079127 A1 | 6/2012 | |
| WO | WO 2012079127 A1 * | 6/2012 | A61B 5/205 |
| WO | WO 2013/113531 A1 | 8/2013 | |

OTHER PUBLICATIONS

International Search Report and Written Opinion for PCT/US2015/011019 dated Mar. 27, 2015.

International Preliminary Report on Patentability for Application No. PCT/US2015/011019 dated Jul. 28, 2016.

* cited by examiner

FIG. 5A
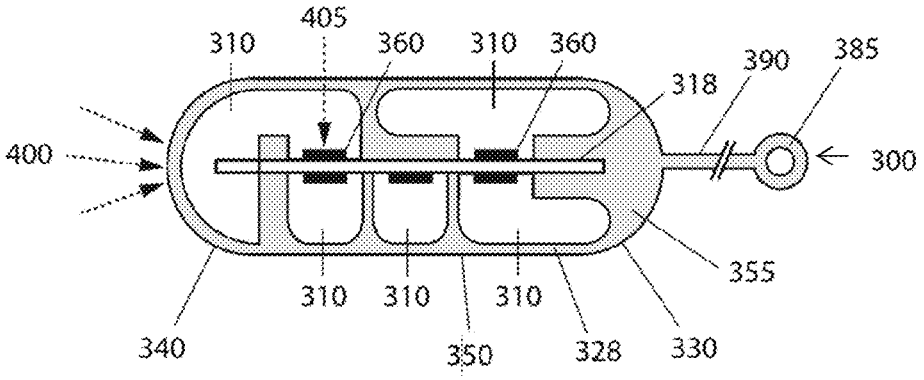
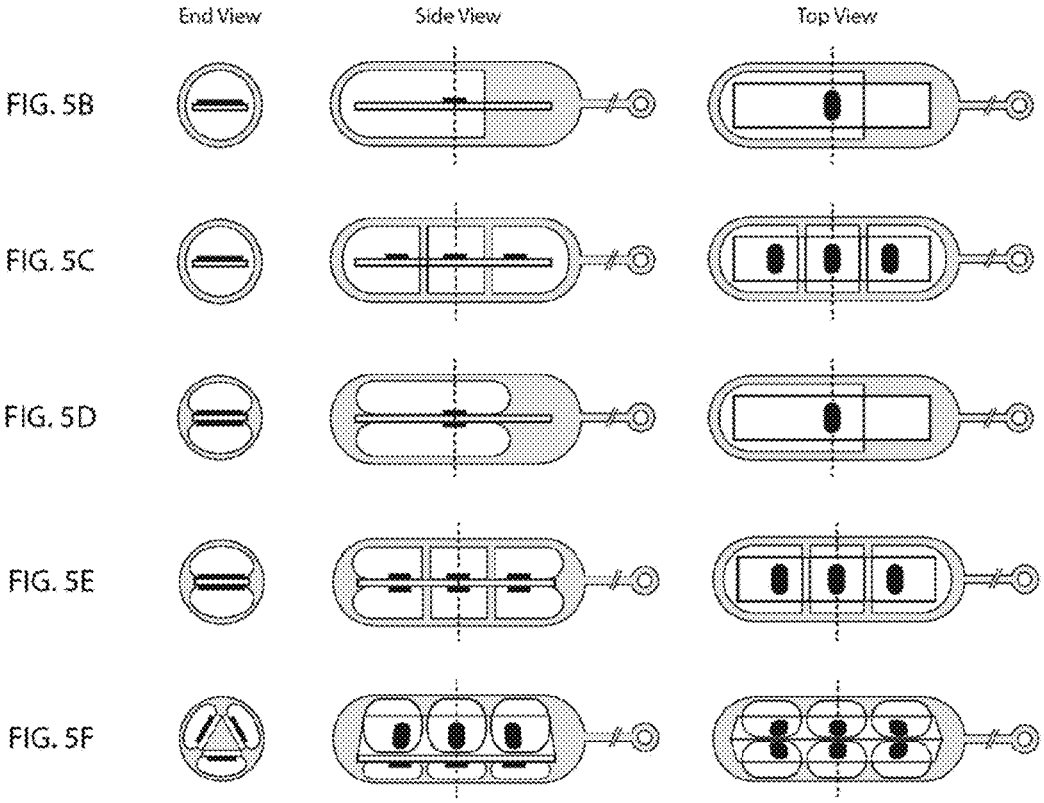
FIG. 5

FIG. 12A
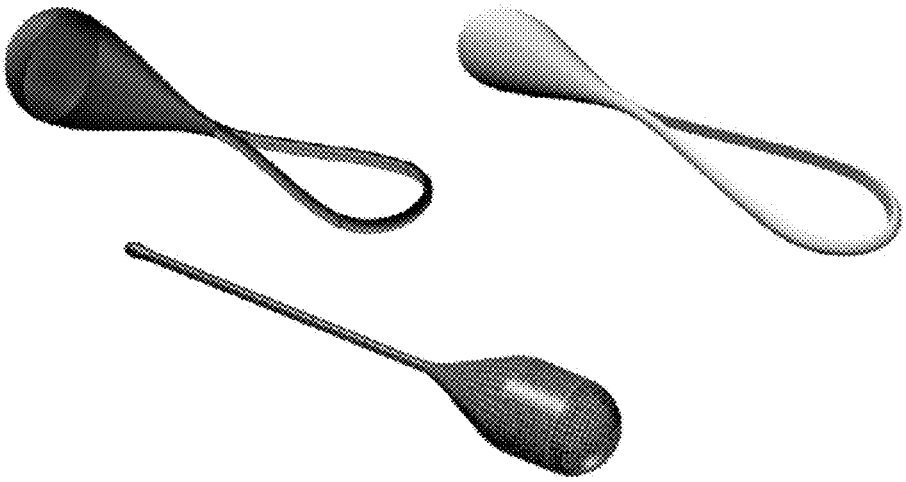
FIG. 12B
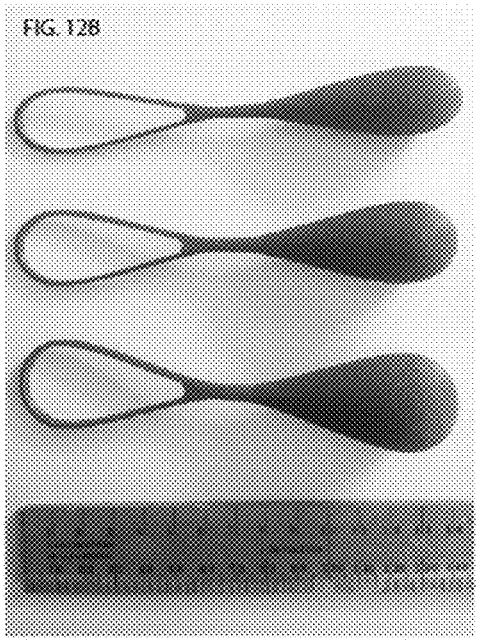
FIG. 12C
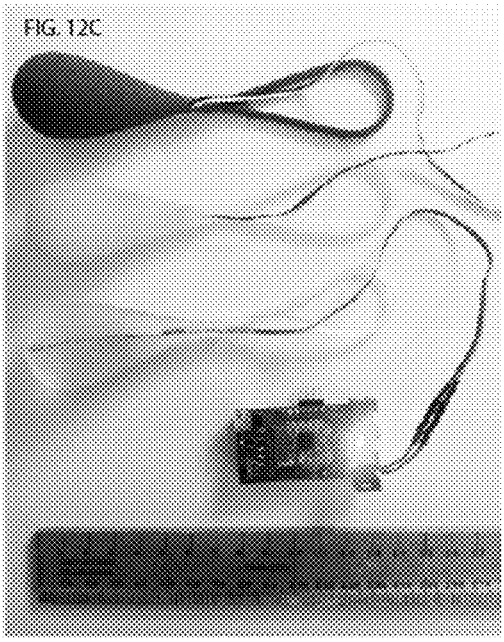
FIG. 12

FIG. 13A
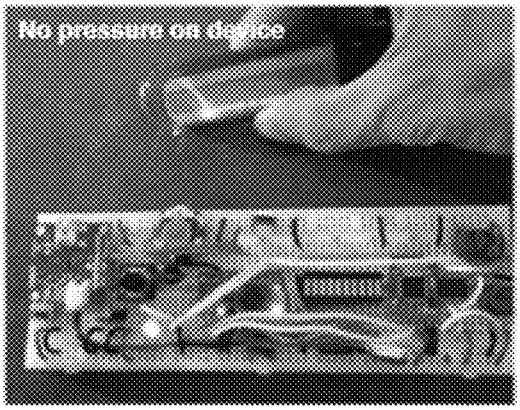
FIG. 13B
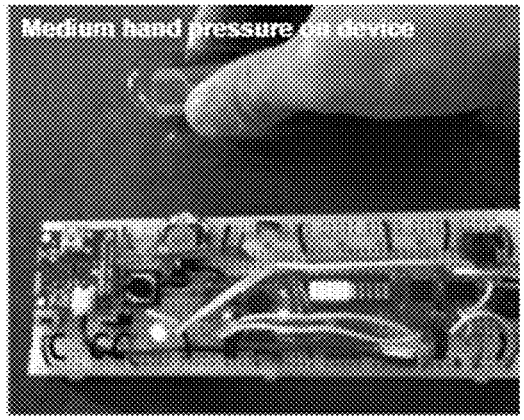
FIG. 13C
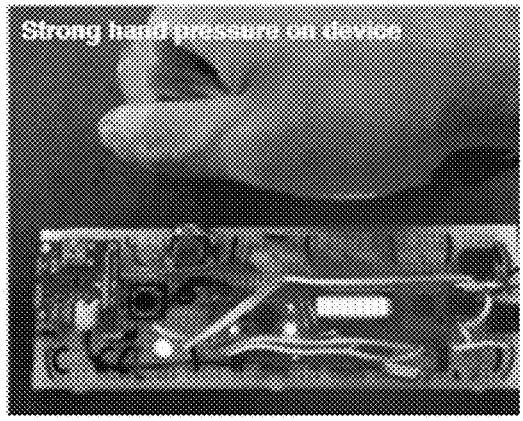
FIG. 13

FIG. 14A
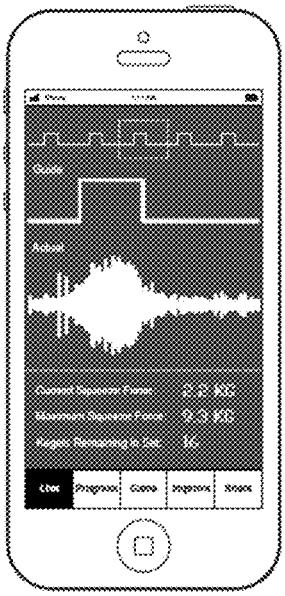
FIG. 14B
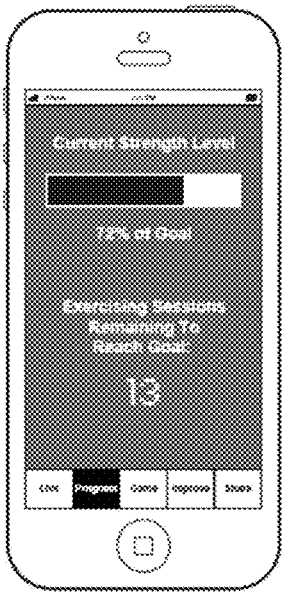
FIG. 14C
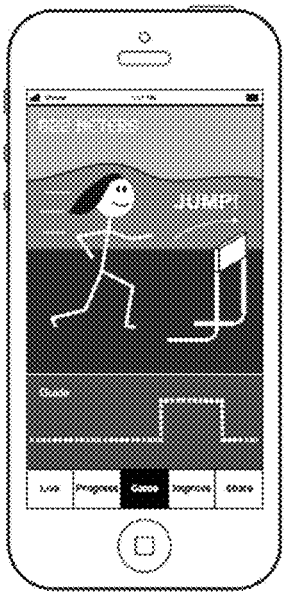
FIG. 14D
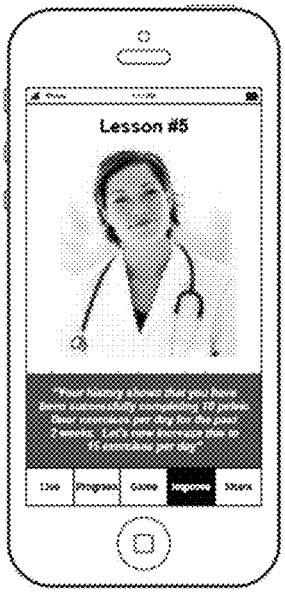
FIG. 14E
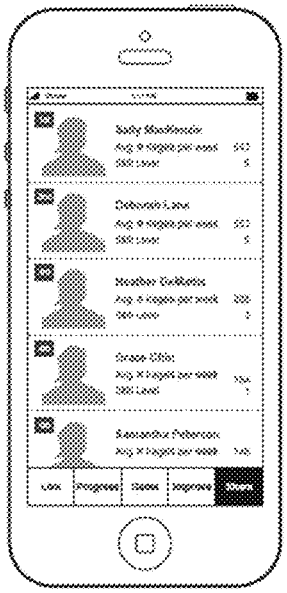
FIG. 14

DEVICE AND METHOD FOR SENSING, GUIDING, AND/OR TRACKING PELVIC EXERCISE

RELATED APPLICATIONS

This application claims priority under 35 U.S.C. § 119(e) to U.S. Provisional Application Ser. No. 61/926,407, filed Jan. 13, 2014, entitled "Device and Method for Sensing and Tracking Pelvic Floor Muscle Contraction in Men and Women," and to U.S. Provisional Application Ser. No. 62/023,196, filed Jul. 11, 2014, entitled "Device and Method for Sensing, Guiding and Tracking Pelvic Muscle Exercise in Men and Women," and to U.S. Provisional Application Ser. No. 62/100,467, filed Jan. 6, 2015, entitled "Device and Method for Sensing, Guiding, and Tracking Pelvic Muscle Exercise," each of which is incorporated herein by reference in its entirety for all purposes.

FIELD OF INVENTION

Devices such as medical devices, including those for use in conducting pelvic muscle exercise, are generally provided. Embodiments herein relate generally to the medical device and consumer medical product fields, and in some embodiments, to a device for sensing, guiding, and/or tracking pelvic muscle exercise in men and women for the purpose of treating urinary incontinence, sexual dysfunction, and other pelvic conditions.

BACKGROUND

Urinary incontinence (UI) is a serious medical condition that affects both men and women. Prevalence rates for women in the US range from 25-55%, with moderate and severe cases affecting 10-20% of all women. The disorder is characterized by involuntary leakage of urine (often excessively so) upon laughing, coughing, sneezing, etc. In addition to its impact on the quality of life, is also associated with more serious medical conditions including urinary infections, skin integrity, falls with fractures, and nursing home placement. In 2000, the total cost burden of urinary incontinence in the US was calculated to exceed $20 billion.

There are several courses of treatment for urinary incontinence, including lifestyle changes (dietary changes, weight loss), behavioral/physical therapy (bladder training, pelvic muscle exercises, pessary use), pharmaceutical therapy (duloxetine), and surgery (urethral sling procedures or bulking agent injection). Given the high medical risks and expense associated with surgery and the limited efficacy of pharmaceutical therapy, lifestyle and behavioral therapies are typically recommended as the first line of treatment for treatment of UI. Pelvic muscle exercises (a.k.a. "Kegels") in particular, have been clinically shown since the 1940s to reduce the symptoms of UI, and are recommended as an initial step toward UI management.

In addition to UI, pelvic muscle exercises are a clinically proven treatment for a variety of other medical conditions including (but not limited to) sexual dysfunction/dissatisfaction, fecal incontinence, vaginal prolapse, and pelvic pain. A non-exhaustive table of clinically studied conditions that are treatable with pelvic floor muscle exercises is shown in TABLE 1. Vaginal childbirth, in particular, is a traumatic event that can cause a stretched pelvic floor (muscles and ligaments), vagina, and surrounding nerves. Some women experience this change in anatomy from vaginal childbirth as the feeling of a "looser" or "roomier" vagina, contributing to a reduction in sexual satisfaction and self-esteem, which can ultimately lead to sexual dysfunction. Physicians and sexual therapists often recommend pelvic floor muscle exercises to treat this condition.

Pelvic muscle exercises are also used to diagnose the conditions described in TABLE 1; professionals (including physicians and physical therapists) often measure pelvic muscle strength as part of the diagnosis of a condition, and/or track progress of that condition over time. Pelvic muscle strength, when measured for this purpose, is often quantified using the Oxford Scale for Muscle Strength, described in TABLE 2.

Pelvic floor muscle exercises comprise contraction and relaxation of the pelvic floor muscles, which are responsible for controlling the flow of urine (among other purposes). A typical course of treatment of pelvic floor muscle exercises for urinary incontinence is a set of ten contractions, two to three times a day, four to seven days a week, for up to 20 weeks. Once the initial course of treatment is complete, the muscles must be maintained through a maintenance regime (e.g., perform the exercises as in treatment but at lower frequency). While most patients are able to accurately follow such a regimen either through self-education or the guidance of a physical therapist, many seek extra guidance, particularly when they are performing the exercises on their own. Specifically, many seek assistance in identifying when a muscle contraction is performed, how many have been performed, and whether each exercise or each set of exercises has been performed correctly. This last point—about performing the exercises correctly (which includes exercising with the appropriate intensity and with the appropriate form)—may be important, as up to 75% of women (and men) perform the exercises incorrectly. For example, many patients incorrectly perform what is called a Valsalva maneuver (the action of attempting to exhale with the nostrils and mouth, or the glottis, closed, hence increasing pressure in the chest and abdomen), when actually attempting to perform a pelvic floor muscle exercise. Performing the incorrect exercise when attempting to perform a pelvic floor muscle exercise can, in fact, be damaging to the tissues, and exacerbate many of the conditions described in TABLE 1.

Given the challenges associated with the diagnosis and treatment of pelvic muscle-related medical conditions described herein, there is need to:

1. Diagnose pelvic-muscle-related medical conditions better
2. Instruct a patient how to perform pelvic exercises with the correct intensity and with the correct form
3. Help a patient monitor whether he or she is performing an exercise with the correct intensity and with the correct form
4. Track/record a patient's progress through pelvic muscle floor exercises over time
5. Monitor increases in the patient's pelvic muscle strength over time
6. Motivate the patient to maintain/comply/adhere to their exercise regimen for its entire duration Certain embodiments described in this application include a device that provides such diagnosis, instruction, feedback, tracking over time, monitoring of muscle strength, and motivation to maintain a correct regimen for pelvic muscle exercises.

SUMMARY OF THE INVENTION

Devices such as medical devices, including those for use in conducting pelvic muscle exercise, are generally provided. Embodiments herein relate generally to the medical device and consumer medical product fields, and in some embodiments, to a device for sensing, guiding, and/or tracking pelvic muscle exercise in men and women for the purpose of treating urinary incontinence, sexual dysfunction, and other pelvic conditions. The subject matter of this application involves, in some cases, interrelated methods, alternative solutions to a particular problem, and/or a plurality of different uses of systems and devices.

In one set of embodiments, a series of devices are provided. In one embodiment, a device for use in conducting pelvic muscle exercise comprises a body portion comprising a first portion, a second portion, and an intermediary portion between the first and second portions, wherein the body portion comprises a flexible polymeric material. The device also includes a sensor, wherein at least a portion of the sensor is embedded in the flexible polymeric material, and wherein the sensor is constructed and arranged to measure a force or pressure applied to the body portion. The device is constructed and arranged to determine a position, at a surface of the body portion, and an intensity, of a force and/or a pressure applied to the body portion.

In another embodiment, a device for use in conducting pelvic muscle exercise comprises a body portion comprising a first portion, a second portion, and an intermediary portion between the first and second portions, wherein the body portion comprises a flexible polymeric material. The device also includes a sensor, wherein at least a portion of the sensor is embedded in the flexible polymeric material, and wherein the sensor is constructed and arranged to measure a force or pressure applied to the body portion. The device includes a cavity containing a fluid positioned between the sensor and a surface of the body portion.

In another embodiment, a device for use in conducting pelvic muscle exercise comprises a body portion comprising a first portion, a second portion, and an intermediary portion between the first and second portions, wherein the body portion comprises a first material comprising flexible polymeric material. The device also includes a sensor, wherein at least a portion of the sensor is embedded in the flexible polymeric material, and wherein the sensor is constructed and arranged to measure a force or pressure applied to the body portion. The device includes a cavity containing a second material different from the first material, the second material positioned between the sensor and a surface of the body portion.

In another set of embodiments, a series of systems are provided. In one embodiment, a system for use in conducting pelvic muscle exercise comprises a device comprising a body portion comprising a first portion, a second portion, and an intermediary portion between the first and second portions, wherein the body portion comprises a flexible polymeric material. The device includes a sensor, wherein at least a portion of the sensor is embedded in the flexible polymeric material, and wherein the sensor is constructed and arranged to measure a force or a pressure applied to a surface of the body portion. The system also includes a processor adapted to be in electronic communication with the device, wherein the processor is programmed to evaluate a pelvic muscle exercise profile of the user at least in part by comparing the pelvic muscle exercise profile of the user with a baseline profile comprising force and/or pressure values as a function of time.

In another embodiment, a system for use in conducting pelvic muscle exercise comprises a device comprising a body portion comprising a first portion, a second portion, and an intermediary portion between the first and second portions, wherein the body portion comprises a flexible polymeric material. The device includes a sensor, wherein at least a portion of the sensor is embedded in the flexible polymeric material, and wherein the sensor is constructed and arranged to measure a force or pressure applied to the body portion. The device is constructed and arranged to generate two or more signals simultaneously as a result of a single act of a user which applies a force or pressure to the body portion, each signal comprising intensity of force or pressure as a function of time.

In another embodiment, a system for use in conducting pelvic muscle exercise comprises a device comprising a body portion comprising a first portion, a second portion, and an intermediary portion between the first and second portions; and a sensor, wherein at least a portion of the sensor is embedded in the flexible polymeric material, and wherein the sensor is constructed and arranged to measure a force or pressure applied to the body portion. The system includes a computer-readable storage medium encoded with a plurality of instructions that, when executed by a computer, performs a method for evaluating a pelvic muscle exercise profile of a user, wherein the method comprises receiving information for a pelvic muscle exercise profile of a user, wherein the pelvic muscle exercise profile of the user comprises force and/or pressure values as a function of time; and evaluating, using at least one processor, the pelvic muscle exercise profile of the user at least in part by comparing the pelvic muscle exercise profile of the user with a baseline profile comprising force and/or pressure values as a function of time.

In another set of embodiments, a series of methods are provided. In one embodiment, a method of evaluating a pelvic muscle exercise profile of a user comprises receiving information for a pelvic muscle exercise profile of a user, wherein the pelvic muscle exercise profile of the user comprises force and/or pressure values as a function of time; and evaluating, using at least one processor, the pelvic muscle exercise profile of the user at least in part by comparing the pelvic muscle exercise profile of the user with a baseline profile comprising force and/or pressure values as a function of time.

Other advantages and novel features of embodiments described herein will become apparent from the following detailed description of various non-limiting embodiments of the invention when considered in conjunction with the accompanying figures. In cases where the present specification and a document incorporated by reference include conflicting and/or inconsistent disclosure, the present specification shall control. If two or more documents incorporated by reference include conflicting and/or inconsistent disclosure with respect to each other, then the document having the later effective date shall control.

BRIEF DESCRIPTION OF THE DRAWINGS

Non-limiting embodiments of the present invention will be described by way of example with reference to the accompanying figures, which are schematic and are not intended to be drawn to scale. In the figures, each identical or nearly identical component illustrated is typically represented by a single numeral. For purposes of clarity, not every component is labeled in every figure, nor is every component of each embodiment of the invention shown where illustration is not necessary to allow those of ordinary skill in the art to understand the invention. In the figures:

FIGS. 5A-5F show various pressure sensor orientations in a device that includes pockets or cavities in the body portion, which may be used to help control how external forces or pressures are recorded by internal force or pressure sensors.

FIGS. 12A-12C show CAD images for potential manifestations of certain embodiments described herein.

FIGS. 13A-13C show photographs of a prototype of a device upon no pressure (FIG. 13A), mid-level pressure (FIG. 13B), and high pressure (FIG. 13C), all exerted from the hand.

FIGS. 14A-14E show illustrative "screen shots" of a potential software program that may be used with certain embodiments described herein.

The following description of certain embodiments of the invention are not intended to limit the invention to these embodiments, but rather to enable any person skilled in the art to make and use this invention.

DETAILED DESCRIPTION

Devices such as medical devices, including those for use in conducting pelvic muscle exercise, are provided. Embodiments herein relate generally to the medical device and consumer medical product fields, and in some embodiments, to a device for sensing, guiding, and/or tracking pelvic muscle exercise in men and women for the purpose of treating urinary incontinence, sexual dysfunction, and other pelvic conditions.

Figure 1:
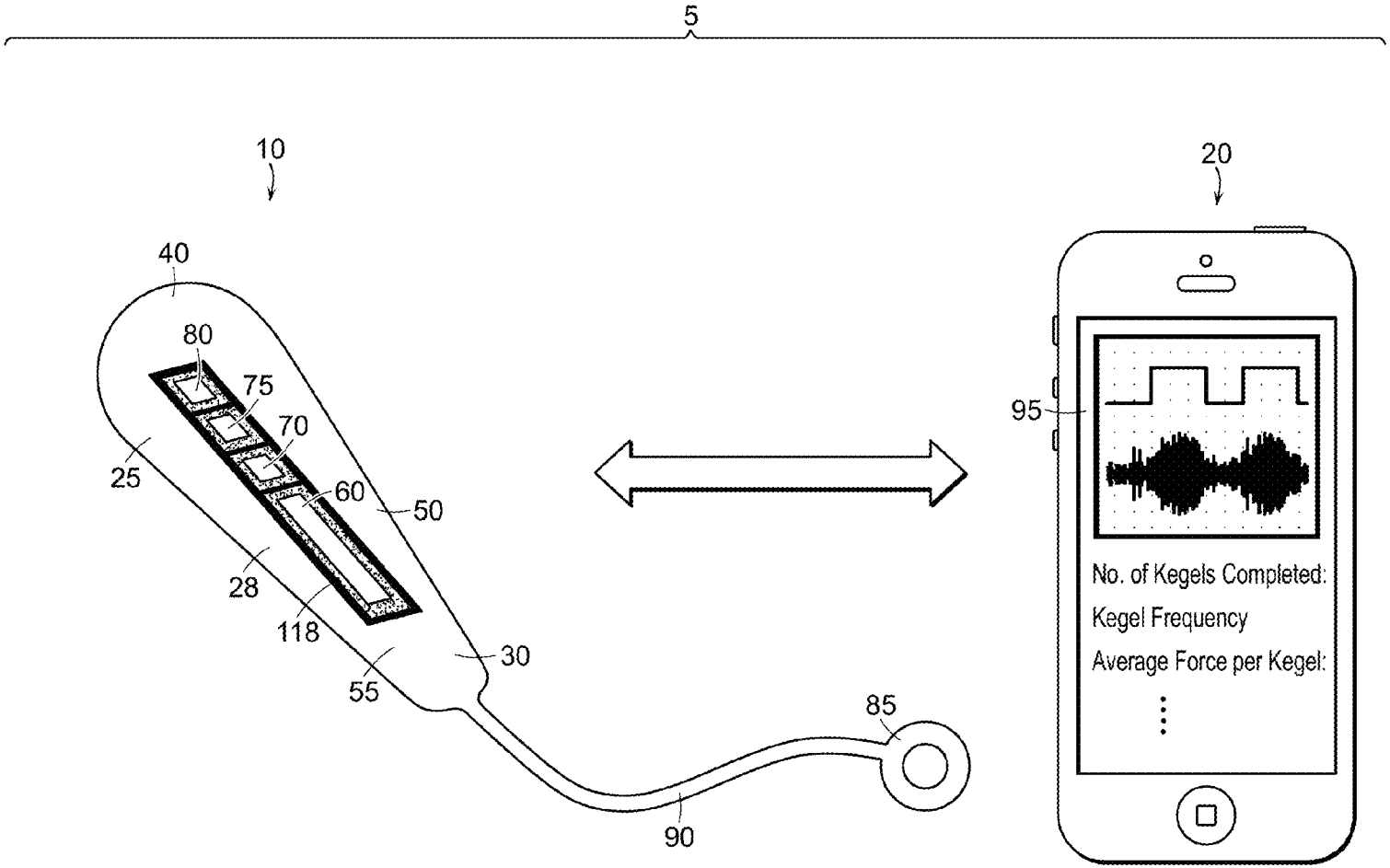
FIG. 1 is an illustration of an exemplary device described herein.

As shown illustratively in FIG. 1, a system 5 for treating urinary incontinence and/or other conditions (e.g., such as those listed in TABLE 1) may comprise a hardware component 10 and a software component 20. In some embodiments, the system is used for enabling a user to conduct pelvic muscle exercises. The hardware component may include a device 25 as described herein. A device may include a body portion 28, which includes a first portion 30, a second portion 40, and an intermediary portion 50 between the first and second portions. As described in more detail below, in some embodiments the body portion comprises a polymeric material 55, such as a flexible polymeric material (e.g., an elastomer sheath). The body portion may have a suitable shape to allow the device to be inserted and maintained in the human body during use.

The device may also include one or more sensor(s) 60, at least a portion of which is embedded in the polymeric material. The sensor may be constructed and arranged to measure a force or pressure applied to the body portion, e.g., from a user conducting Kegel or other pelvic floor muscle contractions or exercises. For instance, a force sensor or pressure sensor including devices such as strain gauges and stress gauges can be used. The device may optionally include an actuator 70, a processor or microprocessor 75, an antenna (not shown), and/or a battery with charging source 80. The device may also include a handle 85 for extracted the device out of the body, as well as an intermediary portion 90 connecting the body portion of the device in the handle. One or more signals 85 measured using the sensor(s) can be transmitted to software component 20. The software component may be, for example, a program running on a smartphone 95 or other computing device, as described in more detail below. The device may also include a structural manifold (H105) 118 that holds the sensor, actuator, battery and/or other components. It should be appreciated that not all components of the device or system shown in FIG. 1 need be present in all embodiments, and that other components may also be present in other embodiments.

In certain embodiments, the device is constructed and arranged to determine a position, at a surface of the body portion, of a force and/or a pressure applied to the body portion, such as when a user is performing a pelvic floor exercise. Measuring a position of the force or pressure being applied to the body portion may be used to determine which muscle or muscle groups a user is contracting or relaxing during a pelvic floor exercise, which in turn may be used to determine whether or not a user is performing an exercise correctly (e.g., an appropriate form of exercise). In some embodiments, the position of the force or pressure being applied to the body portion that is measured may be relative to first portion 30 and second portion 40 of the device. For instance, in certain embodiments more than one sensors are positioned (e.g., in a series) between a first end and a second end of the device, and the multiple sensors can be used to measure multiple forces and/or pressures being exerted by a user along the body portion. In other embodiments, the position of the force or pressure being applied to the body portion that is measured is relative to a position on a perimeter of a cross-section of the body portion (e.g., an axial position). For instance, more than one sensor may be positioned on top and bottom (and/or side) portions of the body portion. For body portions that have a circular or round cross-section, the position may be relative to a circumference of the body portion.

Additionally or alternatively to measuring a position of a force and/or a pressure applied to the body portion, an intensity of a force and/or a pressure applied to the body portion may be measured using the one or more sensors. The force may be an anisotropic force having a component normal to the surface of the body portion that can be measured using the sensor(s). The intensity can be helpful in indicating whether a user is performing an appropriate form of exercise.

In certain embodiments in which a pressure sensor is used, the sensor may be designed to measure a pressure of, for example, at least 15 kPa and up to 126 kPa, although other ranges are also possible. In some embodiments, the sensor may be designed to measure a pressure of at least 15 kPa, at least 30 kPa, at least 45 kPa, at least 60 kPa, at least 75 kPa, at least 90 kPa, at least 105 kPa, or at least 120 kPa. The sensor may be designed to measure a pressure of less than or equal to 126 kPa, less than or equal to 120 kPa, less than or equal to 100 kPa, less than or equal to 80 kPa, less than or equal to 60 kPa, less than or equal to 40 kPa, or less than or equal to 20 kPa. Combinations of the above-referenced ranges are also possible. In some embodiments, a method described herein involves measuring a pressure within one or more of the above-referenced ranges.

In certain embodiments in which a force sensor is used, the sensor may be designed to measure a force of, for example, at least 0 N and up to 100 N (10 kg on earth), although other ranges are also possible. In some embodiments, the sensor may be designed to measure a force of at least 0 N, at least 0.1 N, at least 1 N, at least 10 N, at least 20 N, at least 30 N, at least 40 N, at least 50 N, at least 60 N, at least 70 N, at least 80 N, or at least 90 N. The sensor may be designed to measure a force of less than or equal to 100 N, less than or equal to 90 N, less than or equal to 80 N, less than or equal to 70 N, less than or equal to 80 N, less than or equal to 50 N, less than or equal to 40 N, less than or equal to 30 N, less than or equal to 20 N, or less than or equal to 10 N. Combinations of the above-referenced ranges are also possible. The force measured may be the component of force normal to a surface of the body portion. In some embodiments, a method described herein involves measuring a force within one or more of the above-referenced ranges.

The one or more sensors may also measure frequency of a force and/or pressure (e.g., the number of force and/or pressure exertions as a function of time).

It should be appreciated that a device described herein may have any suitable shape, and that the device may have a different shape than the substantially linear or elongated shape shown illustratively in FIG. 1. For instance, in certain embodiments, the device may have a curved shape or a ring shape. Other shapes are also possible, so long as the device enables sensing of the contraction/relaxation of pelvic floor muscles by the sensor(s), while allowing the device to be maintained in the human body during use and not damaged from such use.

In some embodiments, and as shown illustratively in FIG. 1, first portion 30 and second portion 40 of the body portion may be first and second ends, respectively, of the body portion. For instance, in some embodiments, a first portion may be a distal portion (distal end) and a second portion may be a proximal portion (proximal end) for insertion into the body. It should be appreciated, however, that other configurations are also possible.

As shown illustratively in FIG. 1, the device may include a handle that can be used for extracting device out of the body and/or aiding insertion of the device into the body. The handle may be constructed and arranged to be positioned outside of the body when the device is inserted into the user. In other embodiments, the handle may be designed to be positioned inside the body when the device is inserted into the user. The handle may optionally be attached to an intermediary portion that connects the handle to the body portion of the device. In other embodiments, the handle may be connected directly to, or may be a part of, the body portion of the device. Other configurations of handles are also possible.

As noted above, all or a portion of a device may be inserted into a user's body during use. In some embodiments, the device is designed such that at least 50%, at least 60%, at least 70%, at least 80%, at least 90% or 100%, of the entire volume of the device (e.g., including the body portion and any handle that may be present) is inserted into the body of a user during use of the device. In certain embodiments, less than or equal to 100%, less than or equal to 95%, less than or equal to 85%, less than or equal to 75%, less than or equal to 65%, or less than or equal to 55% of the entire volume of the device (e.g., including the body portion and any handle that may be present) is inserted into the body of a user during use of the device. Combinations of the above-referenced ranges are also possible.

Figure 2:
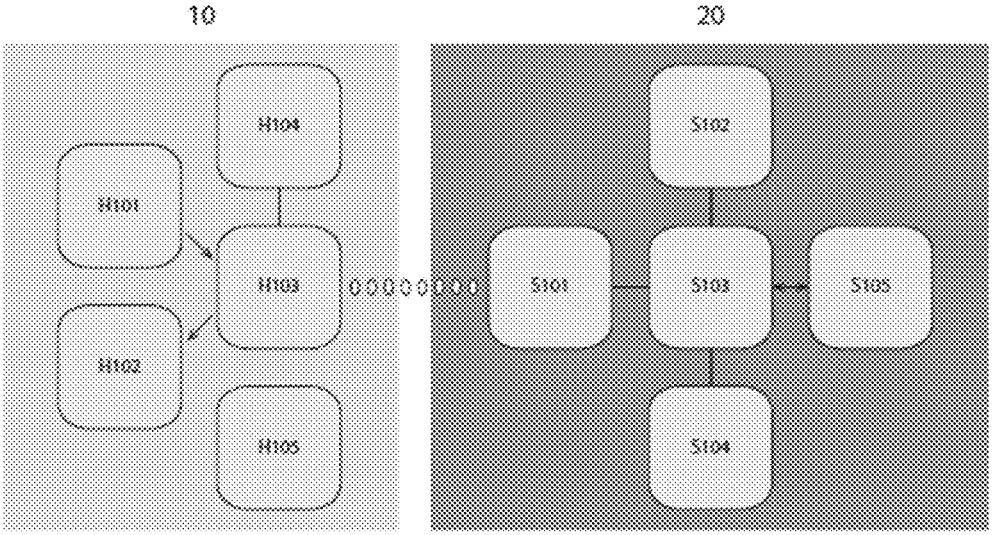
FIG. 2 is a schematic diagram describing the hardware and software components of certain embodiments described herein.

As shown illustratively in FIG. 2, the hardware component 10 of a system may be broken down further into one or more of sensor(s) H101, actuators H102, electronics and processing H103, a power source H104, and a structural manifold H105. The software component 20 may be broken down further into a process or method for receiving data from the hardware component S101, a process or method for interpreting/computing the data S102, a process or method for helping the user receive or see the data in the form of a user interface S103, a process or method for helping the user train/improve in skill based on the data S104, and/or a process or method for allowing the user to share data and training progress with others S105. It should be appreciated that not all components/methods need be present in all embodiments, and that other components not shown in the figure may be present in other embodiments.

Figure 3:
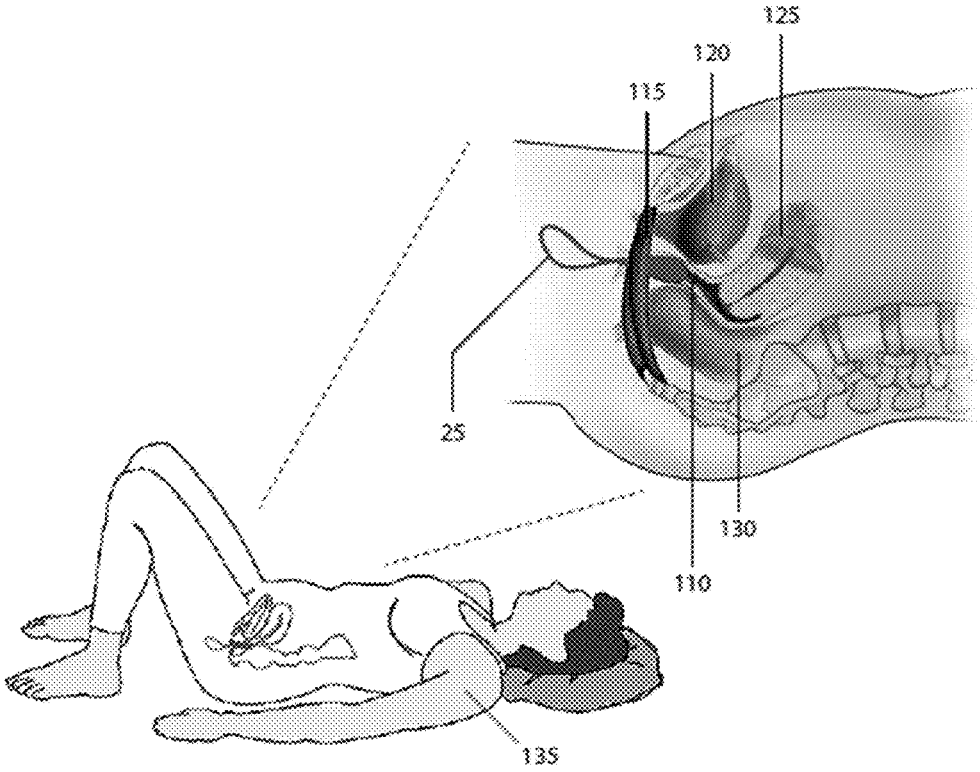
FIG. 3 is an illustration of the use of a device described herein with the human body.

FIG. 3 shows a manifestation of device 25 in which part of the device is inserted inside the vagina 210 of a user 135, e.g., for the purpose of measuring pelvic muscle exercise. FIG. 3 shows the device relative to the pelvic floor muscles 115, bladder 120, uterus 125, and rectum 130.

Hardware

H101 (Sensors). Certain embodiments described herein includes one or more sensors and that are used to detect contraction and/or relaxation of pelvic or other muscle movement in the urogenital area, ultimately to measure and/or record strength, frequency, position, and/or other characteristics. These sensors may take the form of one or several electromechanical sensors, including force sensors (e.g., force sensitive resistors, or FSRs), pressure sensors, flex sensors, accelerometers, or gyros that are embedded within the structural manifold H105 or body portion of a device. In some embodiments, the sensor(s) may be an impedance sensor, a voltage sensor, and/or a current sensor. In certain embodiments, the sensor(s) is/are positioned along the body portion between the first and second portions (e.g., first and second ends) of the body portion. In other embodiments, the sensor(s) is/are positioned at the first or second portions (e.g., first and second ends) of the body portion. In yet other embodiments, the sensor(s) is/are positioned around the body portion (e.g., around a perimeter or circumference of the body portion, or around a core axis of the body portion). The use of force and pressure sensors in particular may be an important distinction (vs. devices that measure just electrical potential directly) in that force and pressure sensors have the capability to measure the contraction of, and hence, ability of a muscle to perform a task, rather than simply the presence or absence of an electrical signal related to that muscle actuation. For example, one can imagine a scenario in which there is high electrical activity around a muscle in a user, but no actual muscle contraction. In certain embodiments, the inability of the user to induce a force or pressure to the body portion can provide meaningful feedback to the user (or his/her doctor). Hence, measuring force and/or pressure provides additional information vs. measuring electrical activity alone.

TABLE 3 describes some of the pressure and force sensors that may be used in different embodiments described herein to detect pelvic muscle contraction. The force sensors listed can detect forces in the range of, for example, 0 to 100 N (10 kg on earth). The pressure sensors listed can detect pressures in the range of, for example, 15-126 kPa (e.g., able to detect increases up to ~30 kPa if measuring at sea level). Some clinical studies have indicated that contracting the levator ani muscles during a pelvic floor contraction (or as part of a more comprehensive exercise) can generate localized forces of up to 10 N, and changes in intravaginal pressure of 10 kPa (1.0 N/cm$^2$).

In some embodiments, certain devices described herein have a design that enables efficient sensing of the contraction/relaxation of pelvic floor muscles by the sensor(s) (e.g., sensor 60 of FIG. 1 and/or sensor H101 of FIG. 2), while maintaining a shape which (i) fits in the human body, and (ii) is not damaged from such use. In one form of a device, a mechanical force sensor or sensors may be embedded entirely (or partially) within the body portion (e.g., body portion 28 of FIG. 1, and may include structural manifold H105 of FIG. 2), which may comprise a bulk elastomer or other material, so that pressing or squeezing on the surface of the body portion or manifold translates the force to the interior sensor. In another form of a device, the sensor or sensors may be mounted upon a hard central manifold (e.g., a plastic block or cylinder), which is subsequently coated entirely by a material (e.g., a polymer, such as an elastomeric polymer) on the surface to generate the body portion or manifold taking the form of a cylinder, the sensors may be arranged to wrap axially around the body portion or manifold, such that force in multiple directions may be sensed. The nature of embedding the sensors inside of the material (e.g., elastomer) may be an important characteristic of certain embodiments described herein. Further detail is provided in the description of the structural manifold H105.

In some embodiments, through the design of the body portion and/or structural manifold H105, the device can be designed to record/measure absolute pressures greater than the maximum pressures recordable/measurable by the pressure sensors (e.g., up to 126 kPa) and forces greater than the absolute forces recordable by the force sensors should they be used (e.g., up to 100 N). This is because the material (e.g., elastomeric material) in which the sensors may be embedded can serve to redistribute and/or dampen the actual pressure or force intent upon the sensor such that applying this force or pressure to the body portion/manifold records a lower pressure that is within the range of the sensor. Hence, should it be desired, the device may be calibrated to record/measure forces in the range of 0 to 1,000 N, or intravaginal pressures in the range 0 to 100 kPa (10 N/cm$^2$). Or stated more simply, embedding the sensors increases their range.

In certain, the device may be designed to measure a force of at least 0 N, at least 10 N, at least 20 N, at least 30 N, at least 40 N, at least 50 N, at least 60 N, at least 70 N, at least 80 N, at least 90 N, at least 100 N, at least 200 N, at least 300 N, at least 400 N, at least 500 N, at least 600 N, at least 700 N, at least 800 N, or at least 900 N. The device may be designed to measure a force of less than or equal to 1000 N, less than or equal to 900 N, less than or equal to 800 N, less than or equal to 700 N, less than or equal to 600 N, less than or equal to 500 N, less than or equal to 400 N, less than or equal to 300 N, less than or equal to 200 N, less than or equal to 100 N, less than or equal to 90 N, less than or equal to 80 N, less than or equal to 70 N, less than or equal to 80 N, less than or equal to 50 N, less than or equal to 40 N, less than or equal to 30 N, less than or equal to 20 N, or less than or equal to 10 N. Combinations of the above-referenced ranges are also possible. The force measured may be the component of force normal to a surface of the body portion. In some embodiments, a method described herein involves measuring a force within one or more of the above-referenced ranges.

In certain embodiments, the device may be designed to measure a pressure (e.g., an intravaginal pressure) of at least 15 kPa, at least 30 kPa, at least 45 kPa, at least 60 kPa, at least 75 kPa, or at least 90 kPa. The sensor may be designed to measure a pressure of less than or equal to 100 kPa, less than or equal to 80 kPa, less than or equal to 60 kPa, less than or equal to 40 kPa, or less than or equal to 20 kPa. Combinations of the above-referenced ranges are also possible. In some embodiments, a method described herein involves measuring a pressure within one or more of the above-referenced ranges.

One characteristic of certain embodiments described herein is the number and placement of the sensor(s). One purpose of the sensor(s) may be to measure force level as is often quantified using the scalar Oxford Scale for Muscle Strength, described in TABLE 2. Additionally or alternatively, through the use of multiple signals (from one or several sensors), certain embodiments described herein may measure the force of the muscles at different locations and from different directions in/on the body, and hence, measure a force or pressure "profile" of the user. This profile may be used to provide information on whether a user is exercising with appropriate intensity and appropriate form of exercise. In one version of a device, a single force sensor may be placed in the center of the manifold to record muscle contraction/relaxation. In another version of a device, sensors may be arranged in series inside, and along the length of the manifold or body portion, such that mechanical force, pressure, or flex at different locations in the manifold or body portion (e.g., front, middle, rear) may be independently sensed. A description of different patterns/orientations for sensors in the device is provided in FIG. 4.

Figure 4:
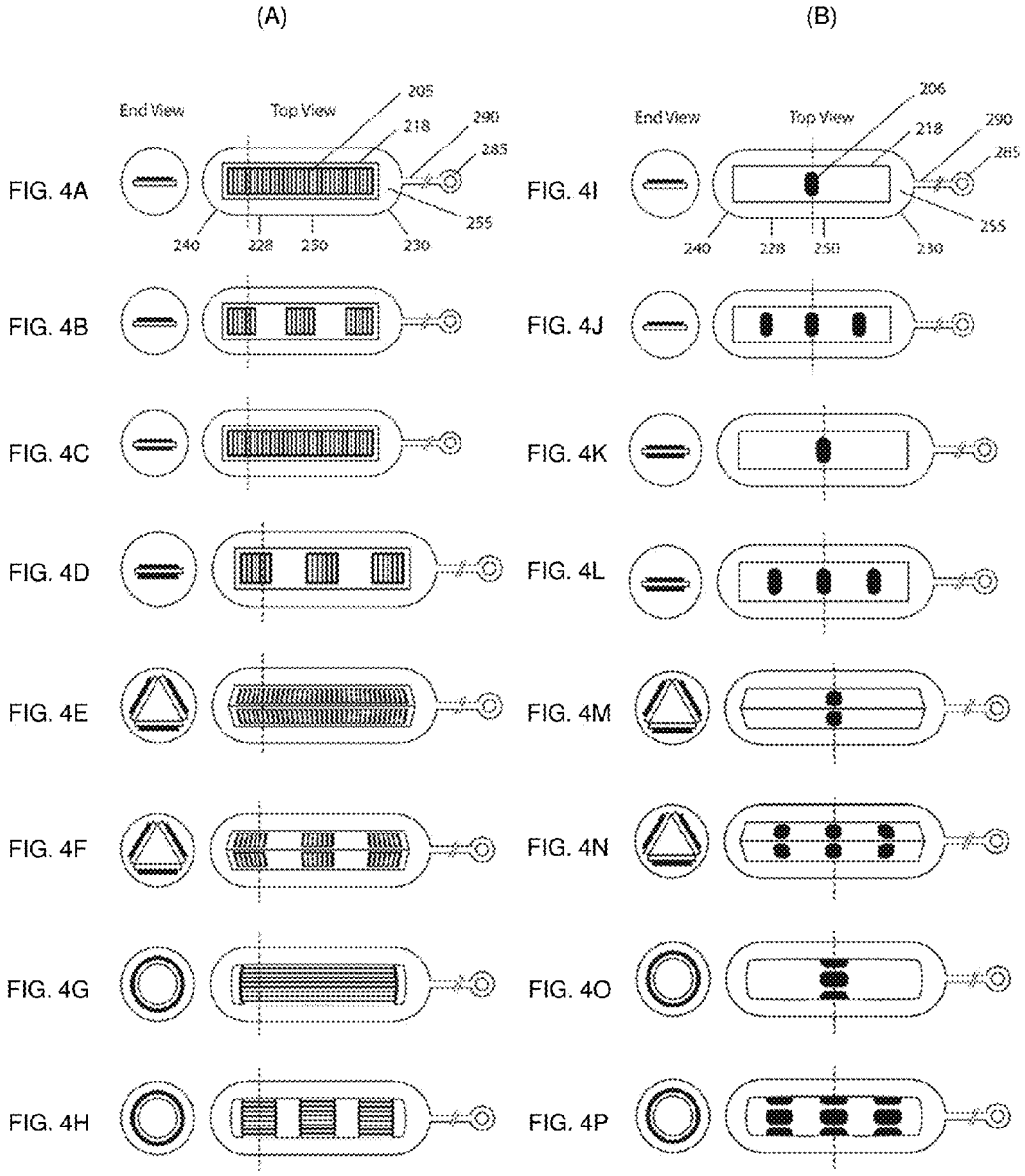
FIGS. 4A-4P show different orientations of force sensor(s) (FIGS. 4A-4H) and/or pressure sensor(s) (FIGS. 4I-4P) (which include sensing devices such as strain gauges and stress gauges) in different embodiments of a device.

FIG. 4 shows examples of end views (A) and top views (B) of orientations of force sensors 205 (left column, FIGS. 4A-4H) and pressure sensors 206 (right column, FIGS. 4I-4P) of devices described herein. The devices include a manifold or PCB 218, a body portion 228, which includes a first portion 230, a second portion 240, an intermediary portion 250 between the first and second portions, a polymeric material 255, a handle 290, and an intermediary portion 285.

In some embodiments, force sensors (such as the Interlink Electronics force sensitive resistors) that can be bent, twisted, or curved, may be used. These force sensors may lead to different patterns and orientations compared to those that are available for pressure sensors.

A device described herein may include any suitable number of sensors (e.g. pressure and/or force sensors). For instance, the device may include at least one, at least 2, at least 3, at least 4, at least 5, at least 6, at least 10, at least 20, at least 30, at least 40, at least 50, or at least 100 sensors. In some embodiments, a device may include less than or equal to 200, less than or equal to 100, less than or equal to 50, less than or equal to 20, less than or equal to 10, or less than or equal to 5 sensors. Combinations of the above-referenced ranges are also possible. Other numbers of sensors are also possible and are not limited to the above referenced ranges.

In an additional embodiment, the body portion may include one or more "pockets" or "cavities" that are used to help control how external forces or pressures are recorded or measured by internally-located force or pressure sensors (FIGS. 5A-5F). As shown illustratively in FIG. 5A, a device 300 may include a pocket or cavity 310 within a body portion 328, which includes a first portion 330, a second portion 340, and an intermediary portion 350 between the first and second portions. The one or more pockets or cavities may contain or be filled with a material (e.g., a first material) that is different in composition than the material used for forming the solid portion of the body portion (e.g., a second material). In some embodiments, the one or more pockets or cavities comprises a fluid such as a gas (e.g., air) or a liquid. In some cases, the one or more pockets or cavities comprises a foam that comprises the fluid. In other embodiments, one or more pockets or cavities comprises a solid. For instances, in some embodiments, the one or more pockets or cavities comprises a first material that is a solid and is softer or has a lower Young's modulus than that of the first material forming the outer portion of the body portion.

In some embodiments, the purpose of these pockets or cavities is to help control how the body portion translates a force or pressure on the surface of a device to a force or pressure sensor 360 located in the interior of the body portion. For instance, through the use of precision-designed cavities, the position, orientation, and/or intensity of an external vector force or pressure can be precisely and appropriately connected to an internal sensor. A cavity filled with a foam in particular, (e.g., polyurethane foam, reticulated polyurethane foam, cross-linked polyethylene foam, polyethylene foam, melamine foam, Neoprene, etc.), may enable the precision linking of an external pressure or force to an internal pressure sensor, while maintaining good structural integrity of the device, and simpler manufacturing, as one can imagine it being easier to mold a structure around a foam than, around an empty gas or liquid cavity. As shown illustratively, the cavity may be positioned between the sensor and a surface of the body portion.

In certain embodiments, a pocket or cavity may be adjacent (e.g., in contact with) a sensor such that at least a portion of the sensor is surrounded by or encapsulated within the pocket or cavity. This configuration can aid in the translation of a force or pressure on the surface of the body portion to a force or pressure sensor located in the interior of the body portion. Advantageously, the sensor(s) need not be directly adjacent to the body portion (or surface of the body portion) to which the force or pressure is applied by the user in order for the sensor to measure a change in force or pressure. For example, as shown illustratively in FIG. 5A, a force or pressure applied at position 400 can be measured by a sensor 360 located at position 405 of the device.

Any suitable number of pockets or cavities in the present in a device. For instance, at least 1, at least 2, at least 3, at least 4, at least 5, at least 6, at least 10, at least 20, at least 30, at least 40, at least 50, or at least 100 pockets or cavities in the present in a device. In some embodiments, a device may include less than or equal to 200, less than or equal to 100, less than or equal to 50, less than or equal to 20, less than or equal to 10, or less than or equal to 5 pockets or cavities. Combinations of the above-referenced ranges are also possible. Other numbers of pockets or cavities are also possible and are not limited to the above referenced ranges.

A device may include any suitable volume that is composed of pockets or cavities. For instance, in some embodiments, the device is designed such that at least 5%, at least 10%, at least 20%, at least 30%, at least 40%, at least 50%, at least 60%, at least 70%, at least 80%, or at least 90% of the entire volume of the device (e.g., including the body portion and any handle that may be present) is formed of or comprises pockets or cavities. In certain embodiments, less than or equal to 90%, less than or equal to 85%, less than or equal to 75%, less than or equal to 65%, less than or equal to 55%, less than or equal to 45%, less than or equal to 35%, less than or equal to 25%, less than or equal to 15%, or less than or equal to 5% of the entire volume of the device (e.g., including the body portion and any handle that may be present) is formed of or comprises pockets or cavities. Combinations of the above-referenced ranges are also possible.

As shown illustratively in FIG. 5A, device 300 also includes a body portion comprising a polymeric material 355, such as a flexible polymeric material (e.g., an elastomer sheath). The body portion may have a suitable shape to allow the device to be inserted and maintained in the human body during use. The device may also include one or more sensor(s) 360 (e.g., pressure sensors), at least a portion of which is embedded in the polymeric material as described herein. The device may optionally include an actuator, a processor or microprocessor (e.g., with RF antenna), and/or a battery with charging source (not shown). The device may also include a handle 385 for extracted the device out of the body, as well as an intermediary portion 390 connecting the body portion of the device in the handle. The device may include a manifold or PCB 318. It should be appreciated that not all components of the device or system shown in FIG. 5A need be present in all embodiments, and that other components may also be present in other embodiments.

In some embodiments, a characteristic of a device described herein is the measurement of baseline pressure or force, or a baseline pressure or force profile. When part or all of the body portion/manifold is inserted into the body of a user (e.g., the vagina or anus), a baseline value can be recorded using the one or more sensors, which may be a fixed value of force or pressure, or an average value of time. This baseline can be used, for example, both as a reference point for measuring Kegel strength, and as a method for determining latent muscle tone over time (e.g., to track progress).

Figure 6:
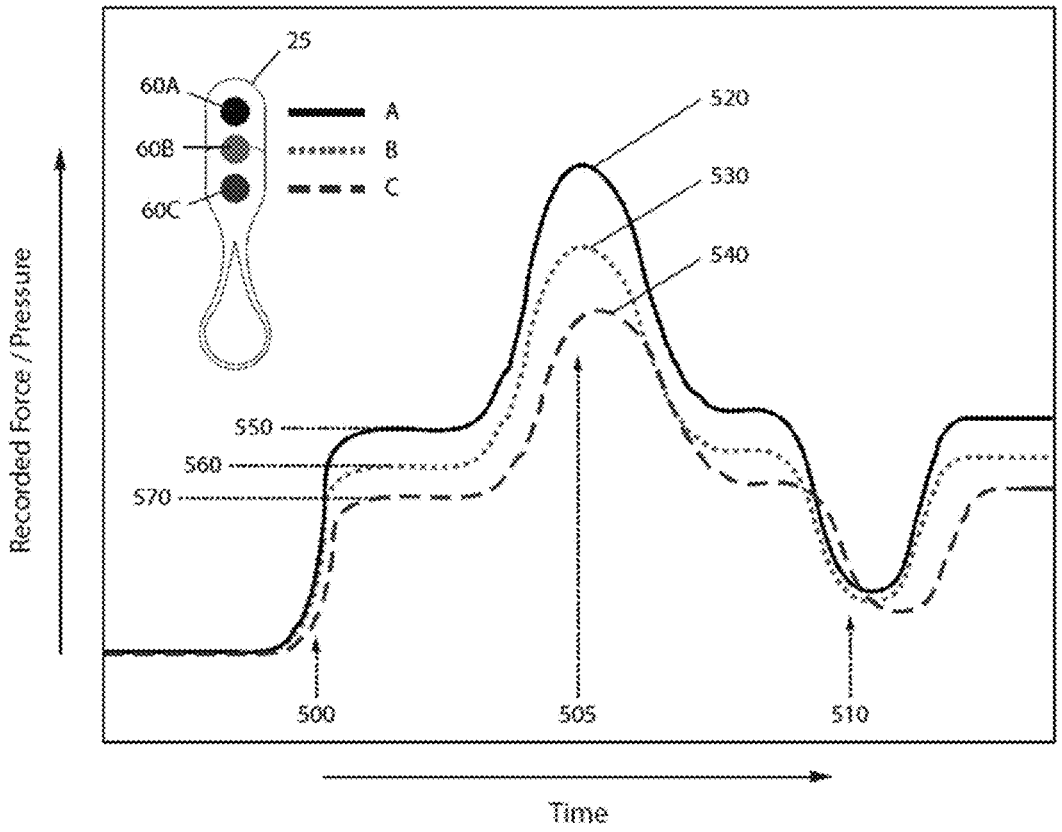
FIG. 6 shows how the signals received from force or pressure sensors over time can be used to measure a force or pressure profile (e.g., set a baseline force profile or pressure profile), and detect pelvic muscle contraction or relaxation.

FIG. 6 shows a hypothetical baseline measurement over time and the use of multiple sensors in a manifestation of a device to create a force or pressure profile, used to identify pelvic muscle contraction or relaxation. Monitoring of baseline pressure or force may be especially helpful in enabling the user to determine not just whether he/she is contracting muscles correctly, but whether he/she is relaxing muscles correctly. In some manifestations of the device, a user with a high baseline pressure or force may be "trained" through correct exercise to have a lower average baseline pressure or force as part of a new therapeutic regimen. Such a regimen may train users to relax muscles, and hence, generate negative forces or pressures in measurement against the baseline. Pelvic muscle relaxation can be used to help train users that may suffer from pelvic pain, vaginismus, or constipation, in which the muscles are often contracted at the baseline state.

In some embodiments, a profile of the user may be compared to a predetermined baseline profile comprising force and/or pressure values as a function of time that may be programmed into a software component of a system described herein. The predetermined baseline profile may include values or ranges of intensity of force or pressure as a function of time that indicate a correct or desired profile of exercises to be followed by the user.

As shown illustratively in FIG. 6, a profile may include more than one sets of force or pressure measurements (e.g., more than one signals, such as signals A, B and C) as a function of time. The more than one sets of force or pressure measurements (e.g., more than one signals) as a function of time may be produced simultaneously as a result of a single act of the user which applies a force or pressure to the body portion of the device. In some cases, the single act results in a change in force or pressure being applied to the body portion. The single act of the user may be, for example, a single contraction or a single relaxation. For instance, the single act of the user may be a muscular act, such as a contraction or a relaxation, made up of instantaneous intensities of force or pressure in time, which together form the more than one sets of force or pressure measurements (e.g., more than one signals). The single act of the user may be the result of a coordinated mechanical process in the body of the user which may involve one or more muscle groups. This single act of the user may directly or indirectly cause a change in force or pressure measured by a sensor. For instance, in some embodiments, an increase in measured force or pressure is not the direct result of a muscle acting directly upon the device, but rather, a muscular act in the individual, that through the mechanics of the body, ultimately leads to a change in force or pressure observed upon the device.

As used herein, one more than one sets of force or pressure measurements (e.g., more than one signals) that are produced simultaneously as a function of time means that the one more than one sets of force or pressure measurements (e.g., more than one signals) are produced at the exact same time, or within a short amount of time (less than 1 second, e.g., less than 1 ms) of one another that may be indiscriminable by the user. For instance, a single act of the user may cause two different sensors to measure/produce signals sequentially at a very high frequency simultaneously (e.g., Sensor 1 measures at 0 ns, Sensor 2 measures at 1 ns, and then Sensor 1 measures again at 2 ns).

In certain embodiments in which the device is constructed and arranged to generate two or more signals simultaneously as a result of a single act of a user which applies a force or pressure to the body portion (e.g., each signal comprising intensity of force or pressure as a function of time), the two or more signals may be produced by two or more sensors at different locations within the device. For instance, in FIG. 6, signal A may be as a result of a sensor 60A measuring a force or pressure located at a first portion of the device 25, signal B may be as a result of a sensor 60B measuring a force or pressure located at a second portion of the device, and signal C may be as a result of a sensor 60C measuring a force or pressure located at a third portion of the device. Time point 500 may indicate the device being inserted into the body (e.g., vagina or anus) of the user, time point 505 may indicate the user performing a pelvic muscle contraction, and time point 510 may indicate the user performing pelvic muscle relaxation. The different location of peaks 520, 530, and 540 as a function of time as a result of the single act of the user performing the pelvic muscle contraction may indicate whether or not certain muscles are being contracted in the correct order in order to perform the correct exercise (e.g., whether the user has appropriate form). The figure shows a baseline level of data stream A labeled 560, a baseline level of data stream B labeled 570, a baseline level of data stream C is labeled 580.

Figure 7:
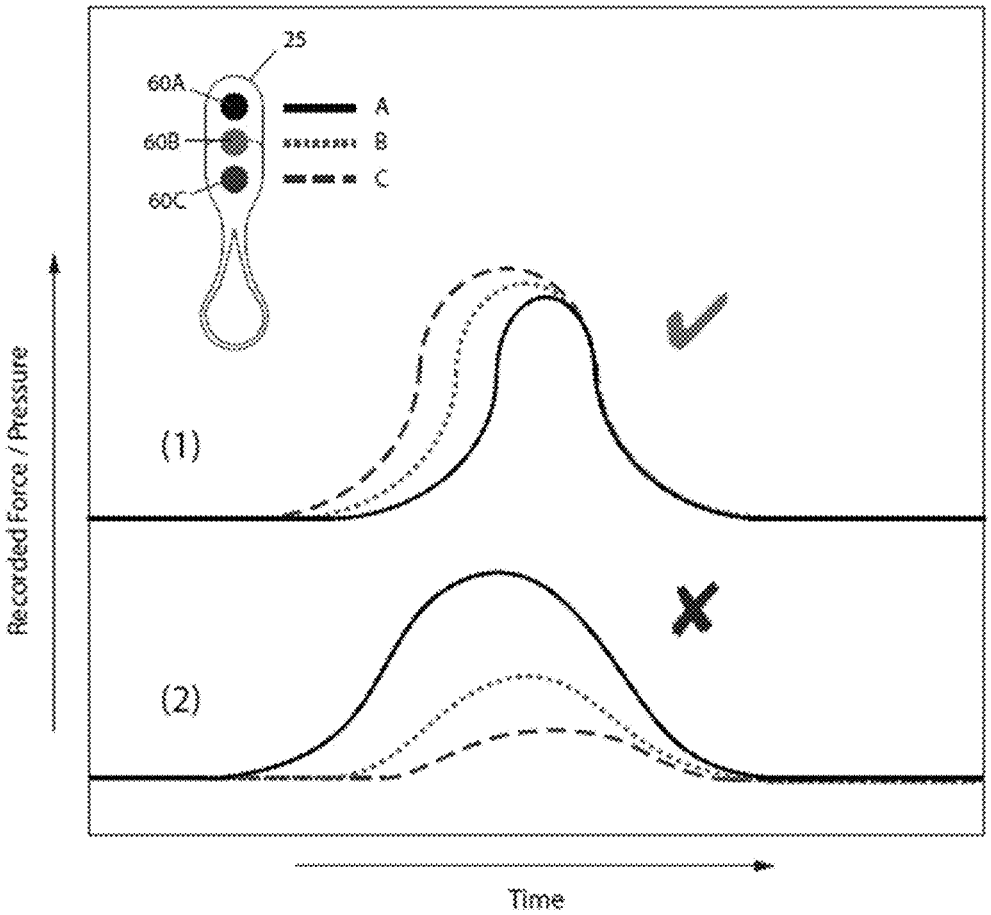
FIG. 7 shows how the signals received from force or pressure sensors over time can be used to discriminate between two specific types of exercises.
Figure 8:
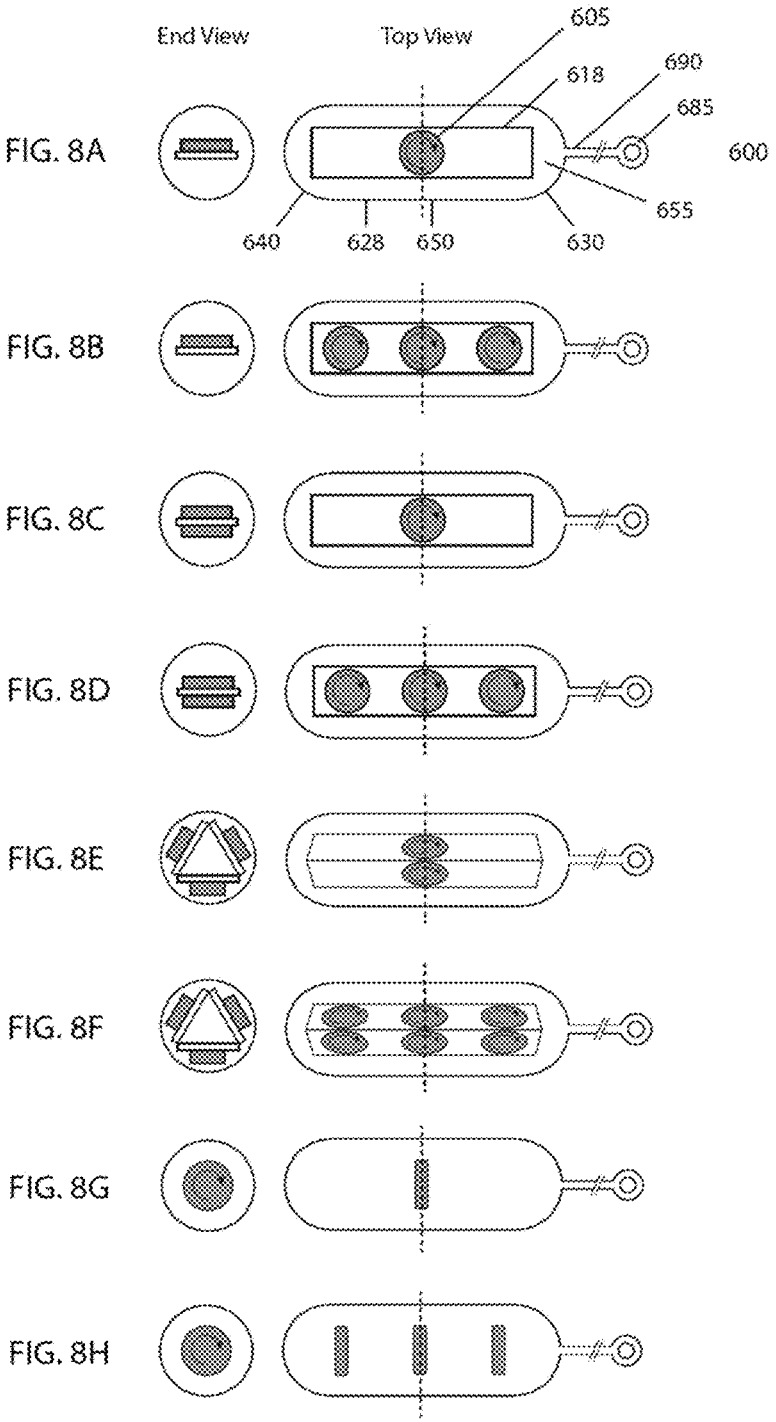
FIGS. 8A-8H show different orientations of actuator(s), which may take the form of vibration motors in different embodiments of a device.

In certain embodiments, use of multiple sensors at different locations can enable a device described herein to discriminate between different types of exercise. FIG. 7 describes the hypothetical profiles of two distinct exercises involving the pelvic region: a pelvic muscle exercise (Kegel) labeled as (1) in FIG. 7, vs. a Valsalva maneuver labeled as (2) in FIG. 7. Both maneuvers can increase the pressure inside the vagina, but create spatially different force or pressure profiles that can be detected by the sensors and communicated to the user. For example, in one embodiment, three sensors 60A, 60B and 60C may be oriented along the length of an elongated device. The detection of a signal from sensor 60C placed closest to the opening of the vagina (nearest to the vulva) before the detection of signals from sensor 60A or 60B positioned closer to the interior to the opening may be indicative of a Kegel exercise; the detection of a signal from sensor 60A placed most interior to the vagina (nearest to the cervix) before the detection of signals from sensors 60B or 60C closer to the exterior to the opening may be indicative of a Valsalva exercise. Hence, the timing of when the signals are received becomes a useful element of the force/pressure profile that can be used to discriminate proper form in performing a pelvic muscle exercise.

Any suitable number of signals (or pattern of signals) may be produced simultaneously using a device described herein, e.g., as a result of a single act of a user which applies a force or pressure to the body portion (e.g., each signal comprising intensity of force or pressure as a function of time). For example, in some embodiments, at least 2, at least 3, at least 4, at least 5, at least 6, at least 10, at least 20, at least 30, at least 40, at least 50, or at least 100 signals may be produced (e.g., simultaneously). In some embodiments, the device may be designed such that less than or equal to 200, less than or equal to 100, less than or equal to 50, less than or equal to 20, less than or equal to 10, or less than or equal to 5 signals (or pattern of signals) may be produced simultaneously using a device described herein. Combinations of the above-referenced ranges are also possible.

In another embodiment, a sensor may be embedded at, for example, the tip of an elongated device. This "tip sensor" may be positioned to be unresponsive or only mildly responsive to the contraction of pelvic floor muscles (e.g., from performance of a Kegel), but responsive to increases in abdominal pressure (e.g., from performance of a Valsalva). Overall, proper design of sensors may be used to generate a comprehensive profile of measurements that may be used to help a computer program or algorithm discriminate between correct and incorrect pelvic muscle exercise.

One aspect of certain embodiments described herein is the ability to detect not just the scalar presence or absence of any force or muscle activity related to exercise, but rather, the ability to detect both the level of muscle contraction ("intensity") and position/direction/orientation ("form") of the contraction. The detection of form is the result, in part, of the use of one or more sensors with the correct position and orientation to monitor the timing, duration, position, angle, and muscle combination necessary to carry out a pelvic muscle exercise with the correct form (e.g., as shown in FIGS. 4-7). Much like an exercise trainer in a weight training gym helps his or her bodybuilders/trainees/students to not just lift the correct weight level, but to lift the weight level with the right form (e.g., "a slow bicep curl with the arm at the side and fingers closed followed by a 5 second hold and a slow release while stabilizing the arm and relaxing the wrist sequentially"), certain embodiments described herein may be designed to help users perform pelvic muscle exercises with the correct intensity and form.

In one set of embodiments, a system for use in conducting pelvic muscle exercise includes a device described herein (e.g., a body portion comprising a first portion, a second portion, an intermediary portion between the first and second portions, and a sensor, wherein the sensor is constructed and arranged to measure a force or a pressure applied to a surface of the body portion). The system also includes a processor adapted to be in electronic communication with the device, wherein the processor is programmed to evaluate the pelvic muscle exercise profile of the user at least in part by comparing the pelvic muscle exercise profile of the user with a baseline profile comprising force and/or pressure values as a function of time. In certain embodiments, the pelvic muscle exercise profile of the user comprises force and/or pressure values as a function of time and position relative to the first and second portions of the body portion of the device. The pelvic muscle exercise profile of the user may comprise, for example, force and/or pressure values as a function of time measured at at least 2, at least 3, at least 4, or at least 5 positions along the body portion of the device. The system may comprise a computer-readable storage medium adapted to be in electronic communication with the device, wherein the computer-readable storage medium is configured to record the pelvic muscle exercise profile of the user.

In one set of embodiments, a system for use in conducting pelvic muscle exercise includes a device described herein (e.g., a body portion comprising a first portion, a second portion, an intermediary portion between the first and second portions, and a sensor, wherein the sensor is constructed and arranged to measure a force or a pressure applied to a surface of the body portion). The device is constructed and arranged to generate two or more signals simultaneously as a result of a single act of a user which applies a force or pressure to the body portion, each signal comprising intensity of force or pressure as a function of time. In certain embodiments, the system comprises a computer-readable storage medium adapted to be in electronic communication with the device, wherein the computer-readable storage medium is configured to record a pelvic muscle exercise profile of a user, wherein the pelvic muscle exercise profile of the user comprises the two or more signals. In some embodiments, the two or more signals comprise intensity of force or pressure as a function of time that are measured at two or more positions along the surface of the body portion of the device. In some such or other embodiments, the sensor(s) of the device are constructed and arranged to measure a force or a pressure applied to the body portion at two or more positions along the surface of the body portion.

In other embodiments, the two or more signals comprise intensity of force or pressure as a function of time that are measured at two or more frequencies. These frequencies may comprise, for example, a "low" frequency (e.g., 10 Hz) and a "high" frequency (e.g., 100 Hz) and/or other frequencies or frequency ranges between 0.1 Hz and 1 MHz. Identification of multiple signals, each at a different frequency or within a different frequency range, is a useful capability, as these signals may be indicative of the contraction of unique muscle groups (e.g., some muscles may "twitch" at a different frequencies or frequency ranges) or more generally, because one may identify in some individuals that unique signal profiles comprised of signals measured at different frequencies are correlated with correct or incorrect pelvic muscle exercise. Through the use of elements such as low-pass, high-pass, bandpass, or notch filters, one may isolate multiple, separate signals from measurements collected from a single source (e.g., a force sensor or pressure sensor) or several sources. In some manifestations of the device, such filtering could be accomplished through electrical filtering (e.g., through the use of passive or active electronic components in a circuit), or software filtering (e.g., use of a software program in the microprocessor or subsequent computing device to isolate signals at different signals mathematically).

In one set of embodiments, a system for use in conducting pelvic muscle exercise includes a device described herein (e.g., a body portion comprising a first portion, a second portion, an intermediary portion between the first and second portions, and a sensor, wherein the sensor is constructed and arranged to measure a force or a pressure applied to a surface of the body portion). The system also includes a computer-readable storage medium encoded with a plurality of instructions that, when executed by a computer, performs a method for evaluating a pelvic muscle exercise profile of a user. The method for evaluating a pelvic muscle exercise profile of a user comprises: receiving information for a pelvic muscle exercise profile of a user, wherein the pelvic muscle exercise profile of the user comprises force and/or pressure values as a function of time; and evaluating, using at least one processor, the pelvic muscle exercise profile of the user at least in part by comparing the pelvic muscle exercise profile of the user with a baseline profile comprising force and/or pressure values as a function of time.

In one set of embodiments, methods of evaluating a pelvic muscle exercise profile of a user are provided. A method may comprise, for example, receiving information for a pelvic muscle exercise profile of a user, wherein the pelvic muscle exercise profile of the user comprises force and/or pressure values as a function of time. The method may also comprise evaluating, using at least one processor, the pelvic muscle exercise profile of the user at least in part by comparing the pelvic muscle exercise profile of the user with a baseline profile comprising force and/or pressure values as a function of time.

H102 (Actuators). Certain embodiments described herein may include one or more actuators that are used to provide a signal to the user. These signals may be used to indicate the beginning, continuation, or end of an exercise. The actuator(s) may take the form of an LED that lights up, a motor that vibrates, a speaker or buzzer that makes a sound, or an actuator that changes the shape of the device in a way that can be sensed by the user. Other actuators also be used. It should be understood, however, that in some embodiments a device does not include an actuator.

In one embodiment, one or several vibration motors are used to provide haptic (touch) feedback to the user. This haptic feedback may be used, for example, to (i) remind the user of the time to complete a pelvic muscle exercise, (ii) indicate the initiation of such an exercise or set of exercises, (iii) guide the user through the exercise (e.g., through the steady increase of a signal from the vibration motor, and/or or (iv) indicate completion of an exercise or set of exercises. For example, certain embodiments described herein may be programmed to provide five, long "buzzes" to indicate that it is time to perform a set of ten pelvic muscle exercises, a short buzz upon the successful completion of each individual exercise, and a long, variable buzz (increasing and decreasing in amplitude) to indicate successful completion of the set. Vibration signals may be varied in timing (when the vibration motor is activated or deactivated), intensity (the amplitude of the signal), and spatial location (which of the set of vibrators is going off). Through variance in timing, intensity, and location, unique haptic signals may be provided to the user.

FIGS. 8A-8H describe some potential orientations of actuators in a device. As shown illustratively in FIG. 8A, a device 600 may include an actuator 605 within a body portion 628, which includes a first portion 630, a second portion 640, and an intermediary portion 650 between the first and second portions. The devices include a manifold or PCB 618, a polymeric material 655, a handle 690, and an intermediary portion 685. The device may also include other components as described herein.

The orientation of the actuators may be important in certain embodiments in that orientation may be used to direct the user to the correct performance of pelvic muscle exercise. For example, in one embodiment, activating a sequence of three motors along the length of the body portion (or structural manifold H105) from anterior-to-center-to-posterior may help guide the user contract muscles from the anterior toward the posterior of the body. In another embodiment, activating a sequence of motors on the top vs. bottom of a device may help guide the user contract muscles from the top to the bottom floor of the vagina.

An additional advantage of providing haptic signals vs. visual signals is that doing so may enable the user to be performing other activities in the day. For example, in one embodiment, a user that is driving a car may receive a signal that it is time to do exercise; he/she may then perform these exercises and receive the signal of their successful completion without having to use a smartphone, tablet, or other device meant to provide visual indicators. Use of such haptic feedback enables the device to be used throughout the day without interrupting routine.

H103 (Electronics and Processing). Certain embodiments described herein may include electronics and processing (e.g., a control system) which is used to convert the output signal of the H101 sensors into a signal that can be recorded by a computer. In one manifestation, these electronics may include components such as a bridge circuit (e.g., a Wheatstone bridge) for sensitive detection of variance in resistance, a differential amplifier to measure small changes in resistance as a result of the mechanical change, an analog-to-digital (AD) converter to convert the amplified signals into bits, a micro-processor to perform control logic on the received signals, and a Bluetooth modem to enable radio-frequency transmission of the signals to a nearby computer, smartphone, or tablet.

In another manifestation of a device, data may be communicated to a nearby computer, smartphone, and/or tablet through a direct cable such as a USB cable. This cable may connect to the device through a port on the external-to-the-body portion of the structural manifold H105, or through a port on the internal-to-the-body portion of the structural manifold H105; for the case of the latter, it may be important in certain embodiments to ensure that the port includes a sealing mechanism (e.g., as in the thin rubber film like in an inflatable basketball or volleyball) to prevent fouling. An example of such a sealing mechanism may be a small, self-sealing, and waterproof hole, through which a narrow, pin-shaped jack (e.g., a headphone jack) may be inserted to enable data communication. In some embodiments, a device described herein includes one or more such or other sealings.

In another manifestation of a device, the processor or microprocessor and Bluetooth modem may be integrated as a single unit. More specifically, one may use the Bluetooth 4.0 protocol (a.k.a. Bluetooth Low Energy, or BLE) to send signals to the nearby computer, smartphone, and/or tablet. Some BLE Chips that may be used in different embodiments described herein include the nRF51822 (Bluetooth Smart and 2.4 GHz proprietary multi-protocol SoC), nRF51422 (ANT/Bluetooth Smart multi-protocol SoC), nRF8001 (Bluetooth Smart Connectivity IC) or nRF8002 (Bluetooth Smart Proximity IC) by Nordic Semiconductor or the CC2540 (2.4GHz BLE SoC), CC2541 (2.4-GHz BLE Proprietary SoC), or CC256x (Bluetooth 4.0+BLE) by Texas Instruments.

It should be appreciated that electronics and processing (e.g., a control system) can be implemented in numerous ways, such as with dedicated hardware or firmware, using a processor or microprocessor that is programmed using microcode or software to perform the functions recited. Electronics and processing may be configured to communicate with one or more components such as a sensor, an actuator, and/or a power source.

H104 (Power Source). Certain embodiments described herein may include a power source to power the electronic hardware of the device. This power source may include a single use or rechargeable battery (e.g., a lithium polymer or lithium ion battery), a voltage regulator, and in the case of a rechargeable battery, electronics to facilitate charging. The method of charging may either be inductive (wireless) or direct (wired). For the case of direct charging, the structural manifold may include a small, self-sealing, and waterproof hole, through which a narrow, pin-shaped jack (e.g., a headphone jack) may be inserted to enable the charging process. For energy conservation, the power source may be designed such that the device is turned off unless a measurement is actively being taken.

In one manifestation of a device, the device may be completely, hermetically sealed at the time of manufacture. A 100% sealed device may be completely inserted into the body with very low risk of fouling. This quality may be important in certain embodiments, given the nature of part of the device being used inside the vagina, which is a chemically and biologically active region of the body with significant bacteria presence and a slightly acidic pH is ranging from 3.8 to 4.5. In addition, a completely sealed device is very easy to clean (e.g., it can be washed in a dishwasher or washing machine without damage). In such a manifestation, charging may be performed inductively through placement on a base structure, which may also serve as a support for storing the device (e.g., at night when not in use). For convenience in aligning the two coils of the inductive charging unit, and providing mechanical support, this base structure may take the form of the inverse of the base of the structural manifold. For example, if the device is convex spherical in shape, the base structure may be concave-spherical in shape (e.g., like a bowl); if the device is convex conical in shape, the base structure may be concave-conical in shape.

Figure 9:
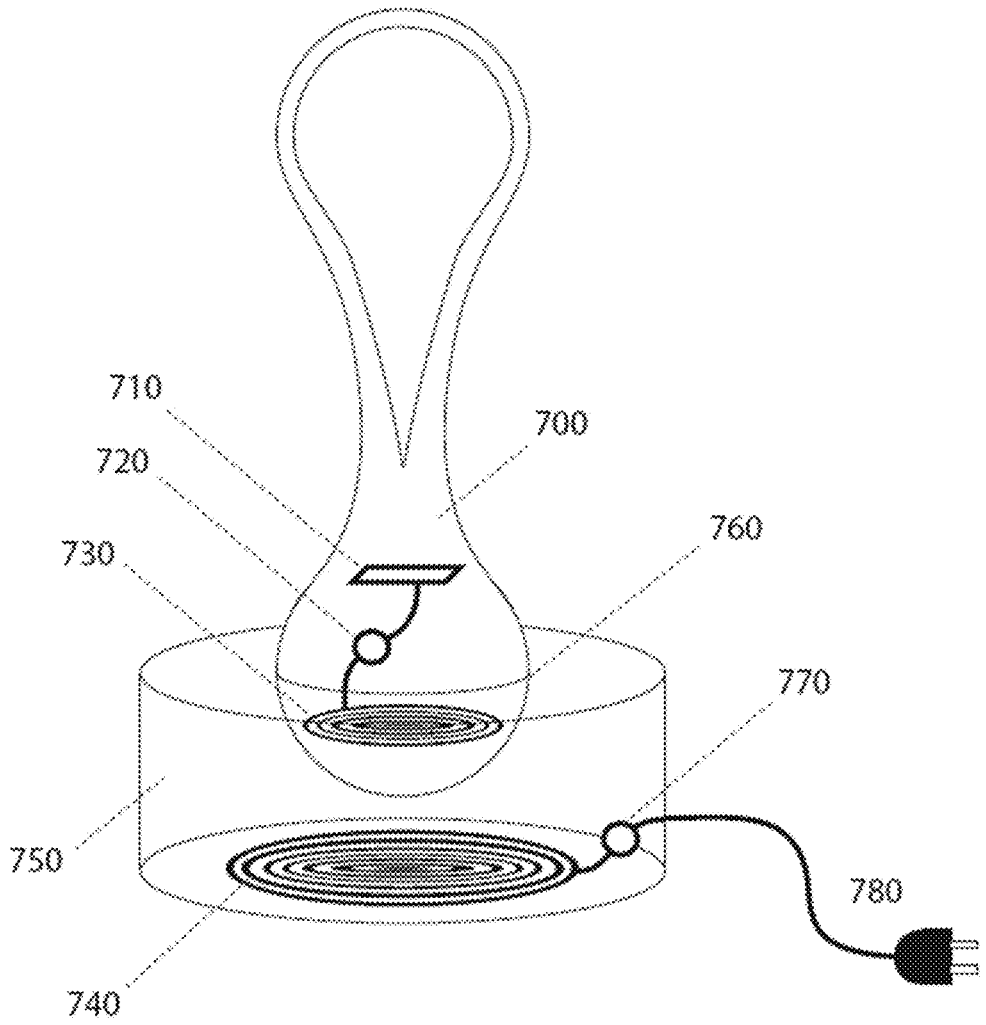
FIG. 9 shows a device in an inductive charging station.

FIG. 9 describes a potential manifestation of the device in an inductive charging station. FIG. 9 shows a device 700 including circuitry 710 (e.g., DC electronic board), conversion electronics 720 (e.g., AC to DC from device coil), device coil 730, basecoil 740, charging base 750 including a pocket 760 in which the device rests during charging, conversion electronics 770, and electrical outlet and/or USB port 780. It should be appreciated that not all components of the device or system shown in FIG. 9 need be present in all embodiments, and that other components may also be present in other embodiments.

H105 (Structural manifold). Certain embodiments described herein may include a structural manifold (e.g., a structure within a body portion of the device) that encloses the electronic hardware (e.g., H101-H104 of FIG. 2) and enables their insertion into and or interaction with the human body. The structural manifold (as well as body portion) may have both internal portions, designed for placement within the vagina and/or anus, and external portions designed for placement external to the vagina and/or anus. FIG. 3 shows one manifestation of the device in which the structural manifold (and body portion) is designed to conform to human anatomy, including the vagina and/or anus.

The structural manifold may have multiple functions, including one or more of the functions (and/or components) below. Accordingly, in some embodiments, a device and/or body portion described herein is constructed and arranged to include one or more of the functions (and/or components) below.

1. To provide a shape that easily conforms to human anatomy (e.g., the vagina and/or anus) to enable the embedded sensors H101 to accurately measure contraction/relaxation of the muscles lining this anatomy.
2. To enable the measurement of various localized pressures or forces within the vagina and/or anus, to enable detection of the correct pressure or force profile at baseline and under different stages of the contraction.
3. To provide a shape that can easily be inserted and removed from the vagina and/or anus. This method of insertion or removal may include an external cable, tab, or loop that the user uses to push the device inside, or pull it out.
4. To mechanically support the interior sensors H101 such that they are able to accurately sense and measure muscle contraction/relaxation of one or several muscle groups.
5. To hermetically seal the interior electronics from the outside environment, which may involve total submersion in fluid. This environment may range significantly in pH, moisture, or temperature, may include corrosive biological material (e.g., bacteria), and may exert significant mechanical stress such as pressure or force on the device.
6. To enable the device to be held inside the vagina and/or anus with comfort, and with minimal additional required force.
7. To function as a pessary, to restrict the flow of urine out of the urethra while in use.
8. To house an antenna that emerges from the vagina or anus, as needed for signal transmission between the device and a smartphone, tablet, or computer.

In some embodiments, the structural manifold and/or body portion may comprise or be made of a polymeric material, such as an elastomeric material. An elastomeric material may be, for example, a rubber or plastic. A table of possible materials for the structural manifold/body portion is provided in TABLE 4. Selection of the right material may influence the correct transfer of force or pressure to the sensors H101. Some selection criteria for materials include flexibility (low Young's modulus), low toxicity, moldability, imperviousness to liquid, etc. Silicones such as Dow-Corning's Sylgard 184 and Smooth-On's Eco-Flex are especially well suited to this purpose, and mold well around force and pressure sensors described in TABLE 3. The range (i.e., "conceivable range") in Young's modulus for materials that have been tested is 0.6-5.5 MPa; however other ranges are also possible, as described below. Elastomers with Young's moduli between 1.0-5.0 MPa work well (i.e., "preferred range") for the designs that have been tested; however other ranges are also possible, as described below.

In certain embodiments, the structural manifold and/or body portion includes a material having a Young's modulus of at least 0.6 MPa, at least 1.0 MPa, at least 1.5 MPa, at least 2.0 MPa, at least 2.5 MPa, at least 3.0 MPa, at least 3.5 MPa, at least 4.0 MPa, at least 4.5 MPa, at least 5.0 MPa, at least 5.5 MPa, at least 6.0 MPa, at least 7.0 MPa, at least 8.0 MPa, at least 9.0 MPa, or at least 10.0 MPa. In some embodiments, the structural manifold/body portion includes a material having a Young's modulus of less than or equal to 10.0 MPa, less than or equal to 9.0 MPa, less than or equal to 8.0 MPa, less than or equal to 7.0 MPa, less than or equal to 6.0 MPa, less than or equal to 5.0 MPa, less than or equal to 4.0 MPa, less than or equal to 3.0 MPa, less than or equal to 2.0 MPa, or less than or equal to 1.0 MPa. Combinations of the above-referenced ranges are also possible. Other ranges are also possible.

In some embodiments, hard plastics or polymers (e.g., having a Young's modulus greater than that of the body portion, and/or greater than 10.0 MPa) may be used for the structural manifold.

In one embodiment, at least a portion of the external surface of the body portion (e.g., elastomer portion of the body portion) may be patterned to ensure stronger grip to the walls of the vagina, and hence prevent the device from falling out. In another embodiment, at least a portion of the external surface of the body portion (e.g., elastomer portion of the body portion) may be functionalized with a chemical or coated with a material that enables a stronger grip to the hydrophilic walls of the vagina, and hence prevents the device from falling out.

The body portion (and/or the structural manifold) may take the form of a variety of sizes or shapes in order to conform best to a variety of forms of human anatomy. FIGS. 10A-10K show several exemplary shapes of the device designed for fit and comfort within the human body during rest and exercise; bulbous, curved/leaf-like, small cylindrical, and large cylindrical forms are described. The vagina, in particular, has a unique shape—it is vertical at the posterior end and horizontal (a.k.a., "smiling") at anterior end. In certain embodiments, a characteristic of the shape is ensuring the internal-portion of the body portion (and/or structural manifold) does not fall out of the vagina during everyday use. Based on anatomy, the length of the insertable portion of the device (not including the tab or loop) in a vagina or anus may range from, for example, 1-25 cm (i.e., conceivable range for length). Typical range for a good fit in the vagina for average women may be in the range of, for example, 2-10 cm in length (i.e., preferred range for length).

In certain embodiments, the length (or longest dimension) of the insertable portion of the device (e.g., the portion of the device designed to be maintained in the body during use, such as the body portion) is at least 1 cm, at least 2 cm, at least 4 cm, at least 6 cm, at least 8 cm, at least 10 cm, at least 12 cm, at least 14 cm, at least 16 cm, at least 18 cm, at least 20 cm, at least 22 cm, or at least 24 cm. In some embodiments, the length (or longest dimension) of the insertable portion of the device is less than or equal to 25 cm, less than or equal to 20 cm, less than or equal to 15 cm, less than or equal to 10 cm, or less than or equal to 5 cm. Combinations of the above-referenced ranges are also possible. Other ranges are also possible.

The diameter (e.g., average diameter) of the insertable portion of the device may range from, for example, 0.1-8 cm (i.e., conceivable range for diameter). Typical range for a good fit in average women may be, for example, 0.5-4 cm in diameter (e.g., average diameter) (i.e., preferred range for diameter).

In certain embodiments, the diameter (e.g., average diameter or cross-section) of the insertable portion of the device (e.g., the portion of the device designed to be maintained in the body during use, such as the body portion) is at least 0.1 cm, at least 0.5 cm, at least 1 cm, at least 2 cm, at least 3 cm, at least 4 cm, at least 5 cm, at least 6 cm, at least 7 cm, or at least 8 cm. In some embodiments, the diameter (e.g., average diameter or cross-section) of the insertable portion of the device is less than or equal to 8 cm, less than or equal to 6 cm, less than or equal to 4 cm, less than or equal to 2 cm, or less than or equal to 2 cm. Combinations of the above-referenced ranges are also possible. Other ranges are also possible.

Figure 10:
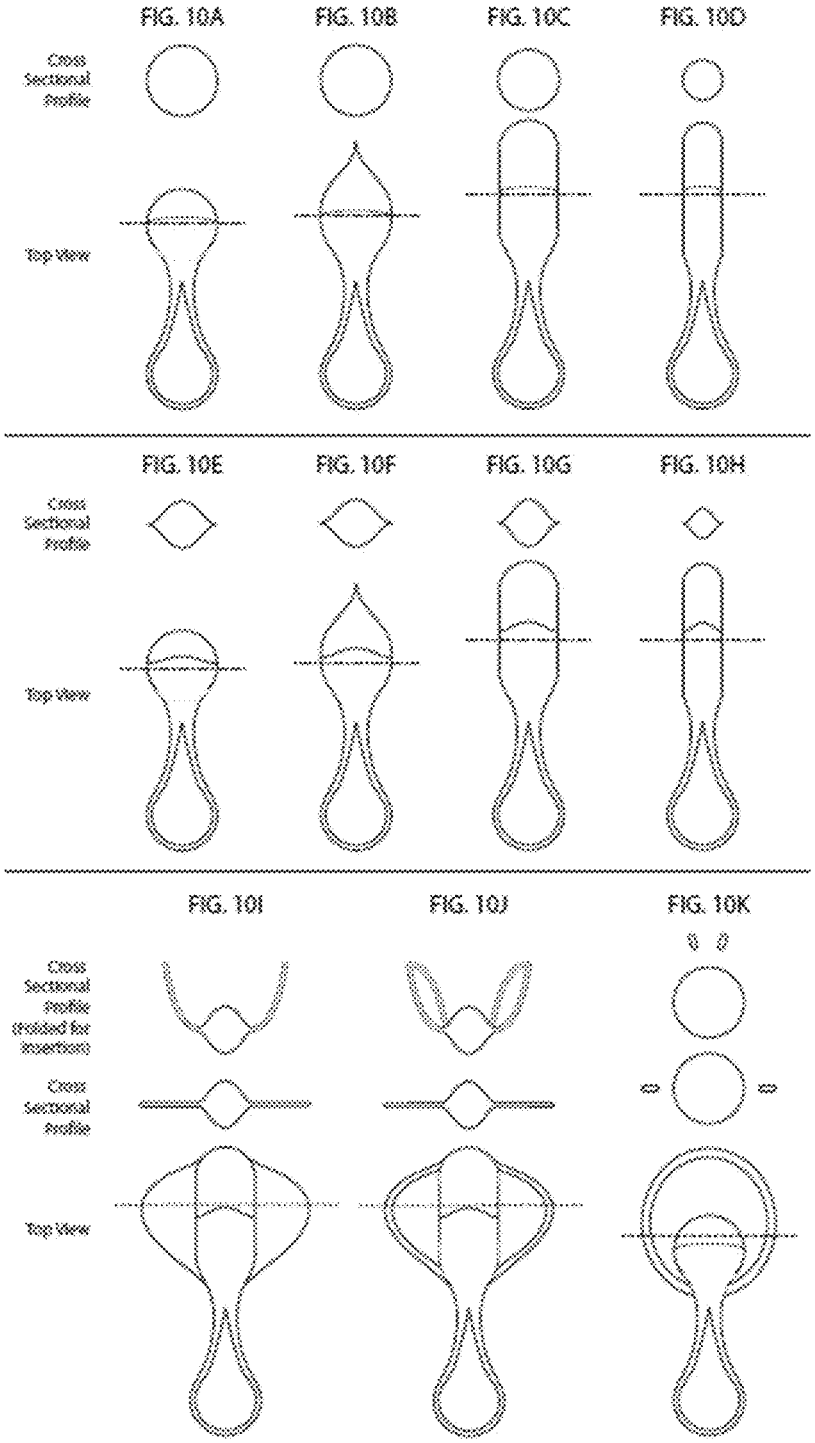
FIGS. 10A-10K show several shapes of the device designed for optimal fit and comfort within the human body during rest and exercise.

FIG. 10 also shows potential versions of shapes that are substantially axially uniform (enabling the device to spin axially after insertion) or axially non-uniform (enabling the device to hold its position axially after insertion). Non-uniform shapes may enable better orientation of the sensors H101 and actuators (H102) in the vagina. Axial non-uniformity can take the form of a shape that is wider in one axial direction than another, or in the form of tabs or loops that extend outward from a central core in one axial direction, but not the other. The presence of flexible "wings" (e.g., made of silicone), "wires", or a "loop" that fold upward or downward, can also help with supporting the structure inside the vagina—a user may fold the tabs or loops up upon insertion that subsequently relax when inside, and help support the entire internal portion of the body portion against the walls of the vagina (much like in existing pessaries). In certain embodiments, the device includes ridges or other structures that may aid in extraction or placement of the device into the body.

In one embodiment, the manifold/body portion may be tapered at one or both ends to facilitate easy insertion and removal from the vagina or anus.

In one manifestation of the device, the body portion may be available in multiple sizes such as small, medium, and large diameter forms (e.g., 2 cm for small, 3 cm for medium, and 4 cm for large). In another embodiment, a user may order a shape customized to his/her internal anatomy. In this latter embodiment, there may be a mechanism for measuring vaginal width/height/depth, or general shape, and then using this information to either select the correct size of the device, or order a customized version of the device.

Figure 11:
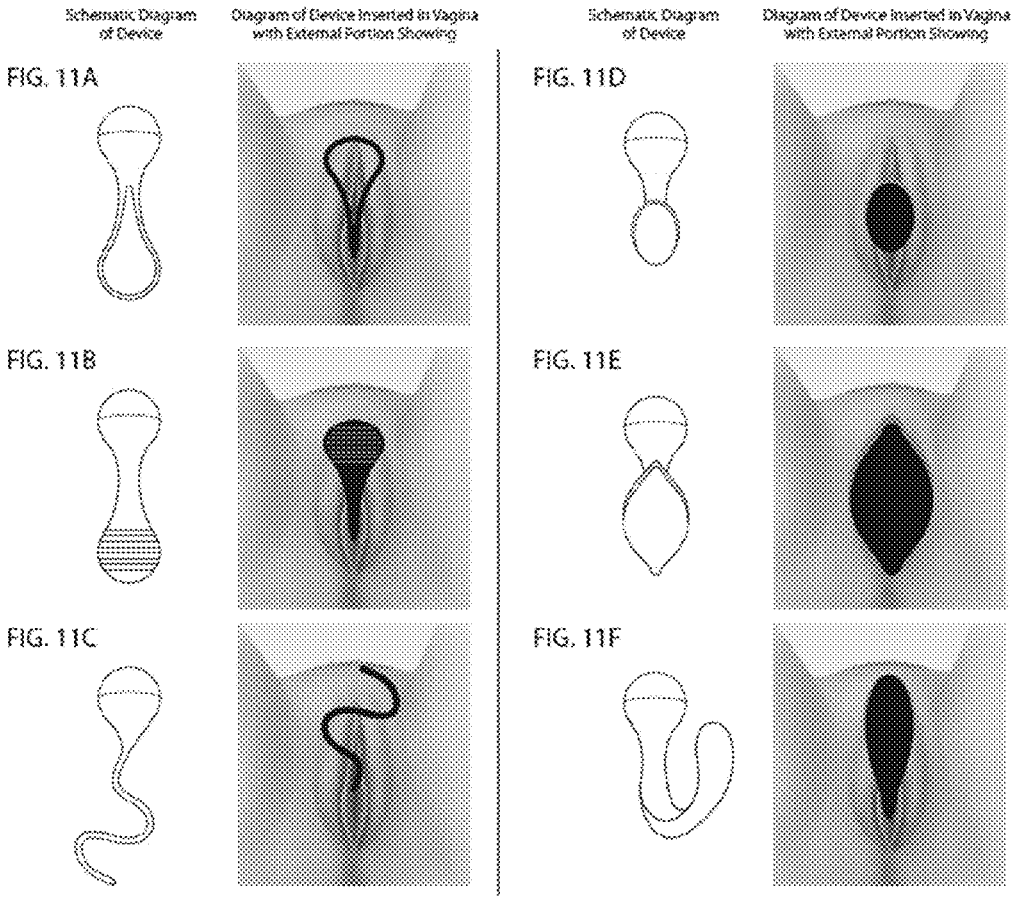
FIGS. 11A-11F show several potential manifestations of the part of the device external to the human body.

In one embodiment, the device may take the shape or include a part that has the shape of a pessary, such as a ring pessary, a donut pessary, a dish pessary, a cube pessary, a Hodge pessary, a Gehrung pessary, or a Gellhorn pessary. Pessaries can be used in the vagina or rectum to treat incontinence and prolapse and come in different sizes and shapes for comfortable fit. In such embodiments, the sensor(s) used for tracking muscle contraction may be placed in the area of the pessary for measurement of pelvic muscle contraction. For example, in an embodiment comprising a donut pessary, the sensors may be placed in the external portion of the ring for close contact with surrounding fascia, or in an additional part of the device that extends through the vagina that is closer in proximity to pelvic muscles such as the levator ani muscles. In a subset of a pessary-based embodiment of the invention, a portion of the device may extend outside of the body (e.g., for easy insertion/removal, and/or to house the antenna as described in FIG. 11).

FIGS. 11A-11F shows different potential manifestations of "exterior" portion of a device. Different potential manifestations of the external portion of the device include a loop, tab, string, block, shield, or clip. The different manifestations represent trade-offs in comfort, pressure against the clitoris or other sensitive areas, avoidance of part of the device obstructing the urine stream, and potential support of holding the device inside of the vagina during activity and rest (in the form of the block, shield, or clip).

The human body attenuates radiofrequency signals at and around 2.4 GHz, which is the frequency commonly used for Bluetooth and other electronic wireless communication protocols. The external portion of the structural manifold H105 and/or body portion described herein may be designed to pass outside of the body through the vaginal opening, and hence, this tab/handle may also house an antenna, enabling the device to send and receive stronger signals to a smartphone, tablet, or computer. The antenna may take the form of, for example, a single wire, two wires (dipole) a loop, or a more complex antenna design.

In one form of the device, the structural manifold and/or body portion may take the form of a cylindrical elastomer, in whose center/interior the electronics (e.g., electronics H101-H104) are contained or embedded. The elastomer may be a silicone such as polydimethylsiloxane (PDMS), a polyether or polyester urethane, or another biocompatible polymer. The manufacturing process for such a manifold may include, for example, a two or three-part elastomeric mold surrounding a PC-board, or a PC-board mounted to a hard central manifold. The mold may include a tab, made of the same or a different (reinforced) elastomeric material, to enable purpose 2 above (easy insertion or removal from the vagina and/or anus).

FIGS. 12A-12C show several CAD drawings, sizing prototypes, and functional prototypes that represent potential manifestations of a device described herein.

FIGS. 13A-13C show photographs of a prototype of the device upon no force, medium-force, and high force, all exerted from a human hand. The range in force from the hand is in the general range of 0-600 N. The intensity of the force imparted on the device is shown through the sequence of LEDs that light up in proportion to the force of the squeeze. Sensitivity of the light sequence to the force of the squeeze is adjustable through turning the potentiometers of the bridge circuit, located on the far right of the photographs.

Figure 15:
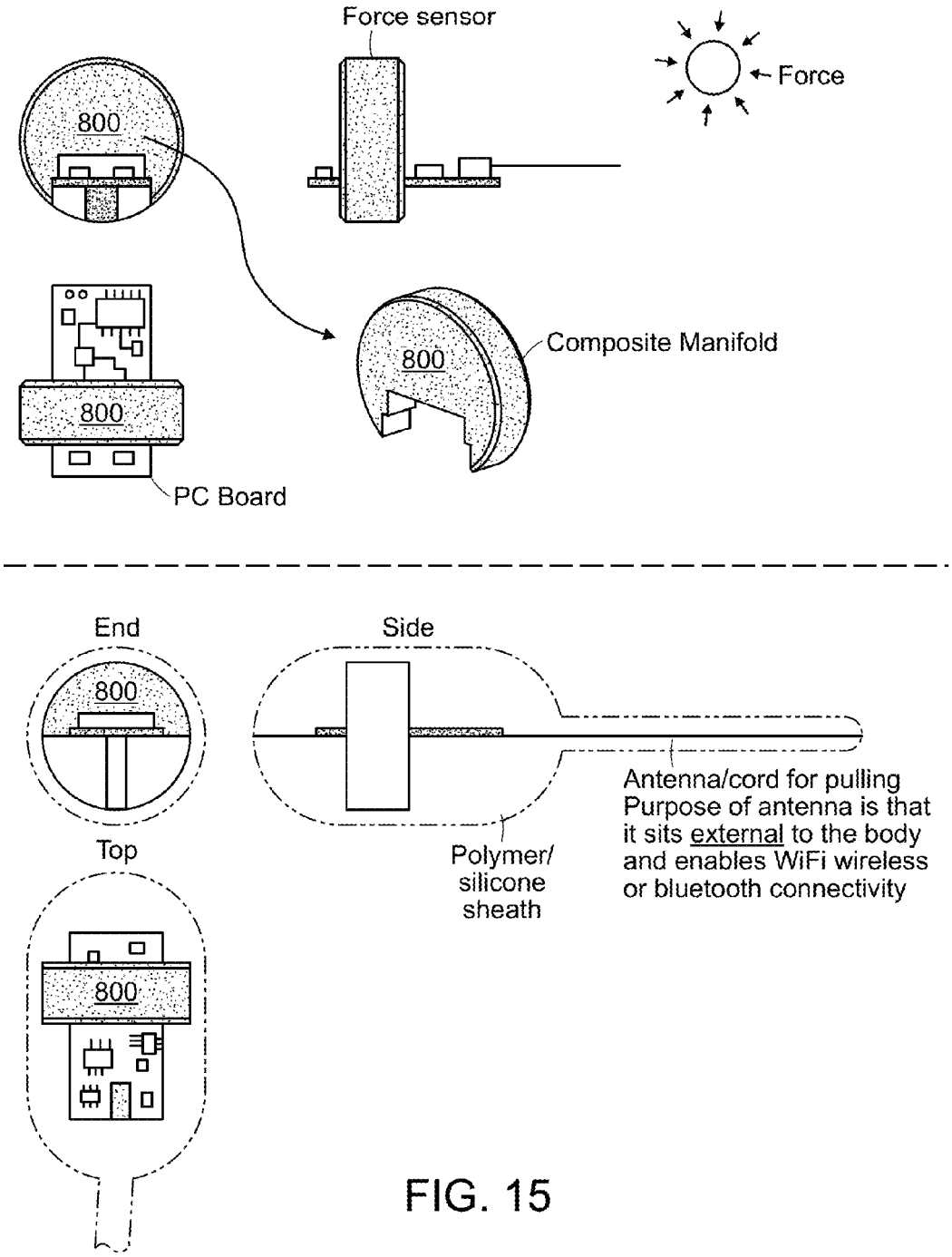
FIG. 15 shows a shape of a structural manifold 800 for holding a force sensor (and optionally other components such as circuitry/processor(s)) in a ring/axial orientation inside a polymer (e.g., flexible polymer).
Figure 16:
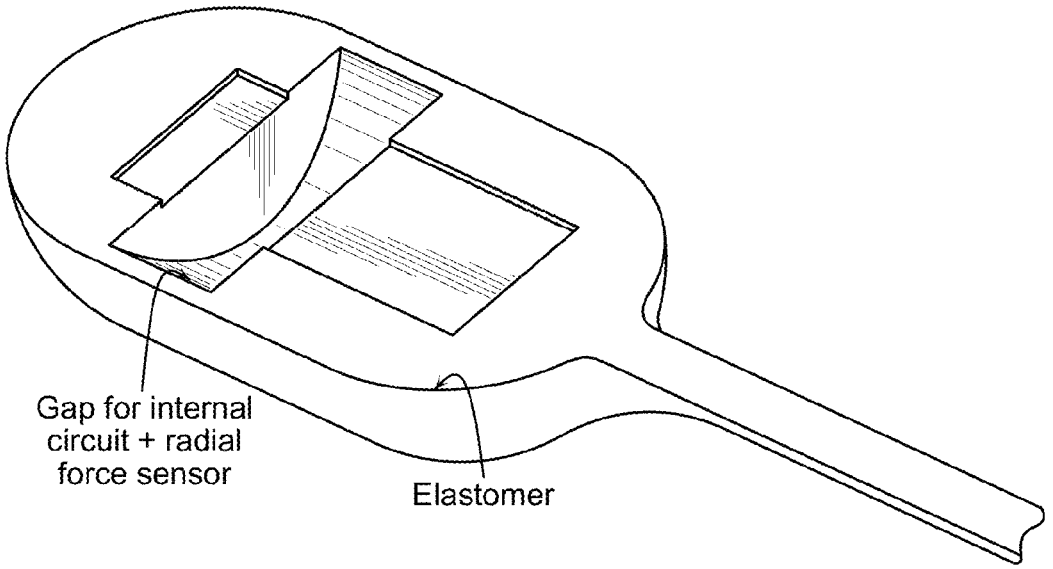
FIG. 16 shows a shape of a body portion/polymer (e.g., flexible polymer) used to house the structural manifold shown in FIG. 15.
Figure 16:
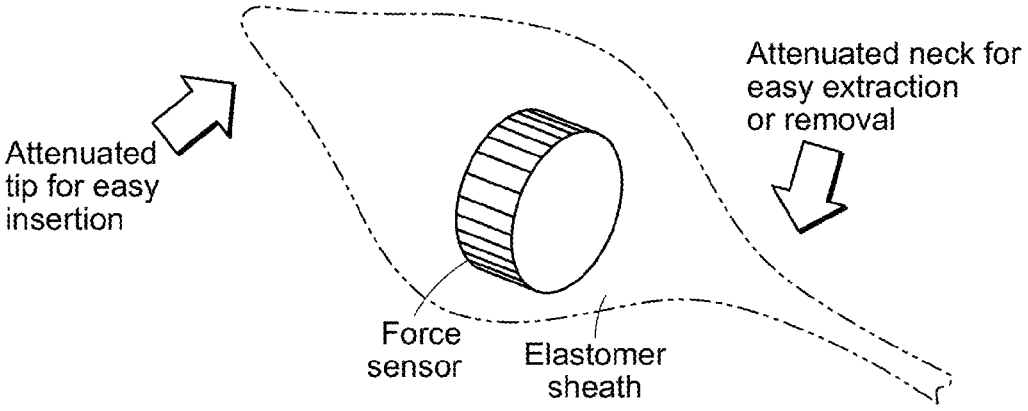
Figure 17:
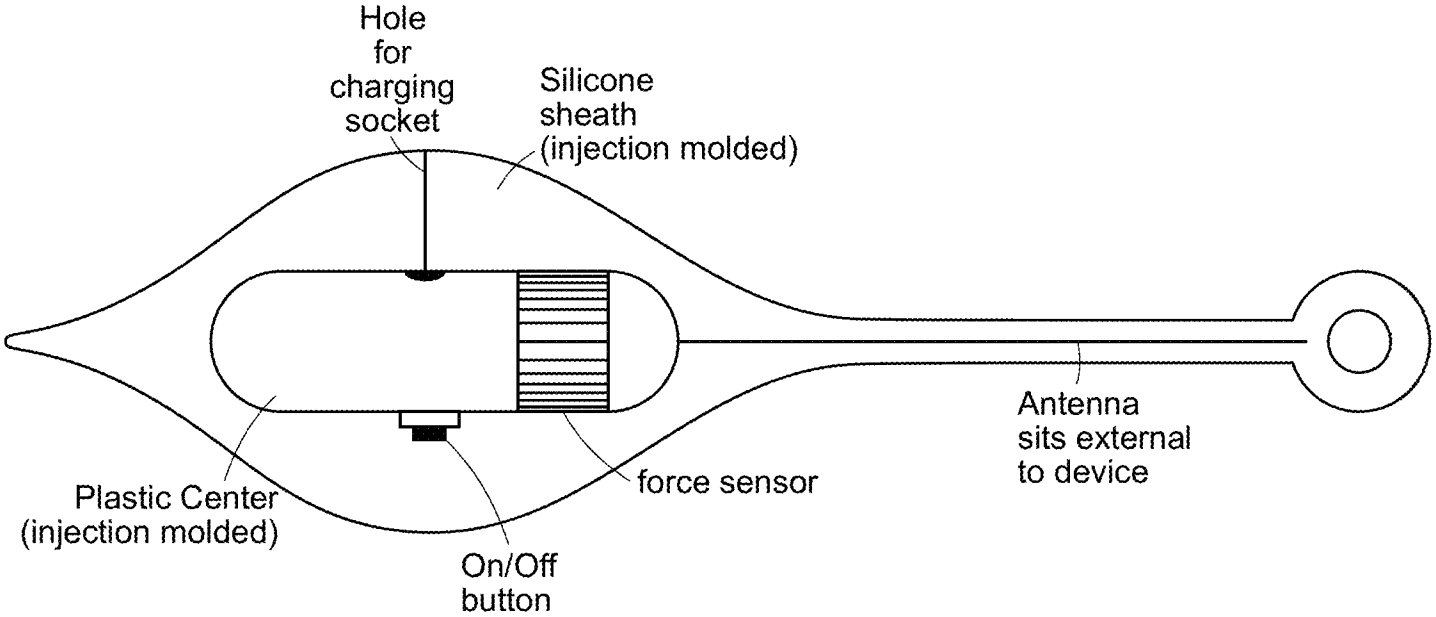
FIG. 17 shows a shape of a body portion/flexible polymer in which an on/off switch and antenna have been embedded.
Figure 18:
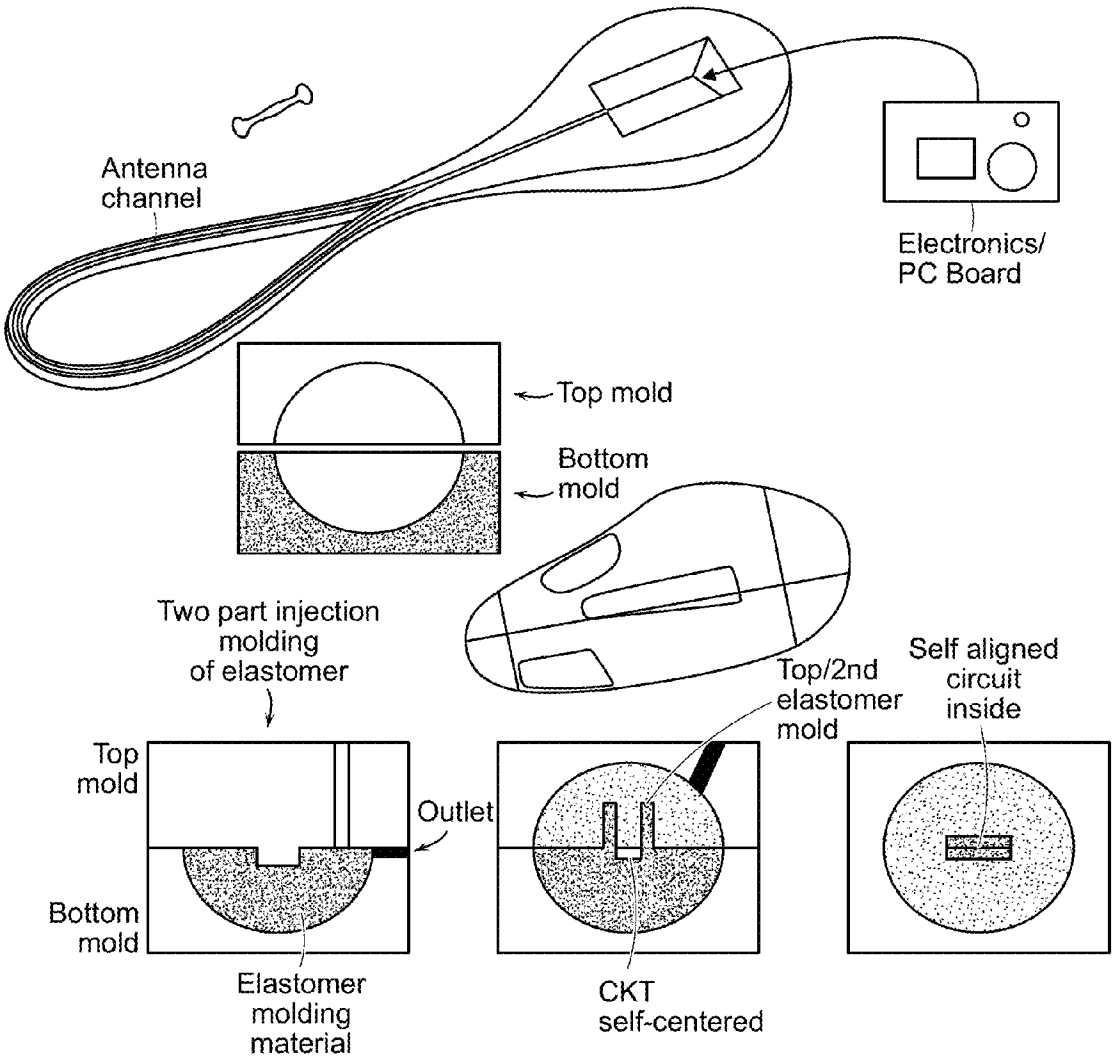
FIG. 18 shows a potential method for manufacturing the body portion/flexible polymer using two-part or multi-part injection molding.

FIGS. 15-18 show additional diagrams of different versions of the hardware of certain embodiments described herein, including designs for the structural manifold, body portion/flexible polymer, and manufacturing techniques. For example, FIG. 15 shows a shape of a structural manifold 800 (e.g., a hard structural manifold) for holding a force sensor (and optionally other components such as circuitry/processor(s)) in a ring/axial orientation inside a polymer (e.g., flexible polymer). FIG. 16 shows a shape of a body portion/polymer (e.g., flexible polymer) used to house the structural manifold shown in FIG. 15. FIG. 17 shows a shape of a body portion/flexible polymer in which an on/off switch and antenna have been embedded. FIG. 18 shows a potential method for manufacturing the body portion/flexible polymer using two-part or multi-part injection molding.

Software

The calculation methods, steps, simulations, algorithms, systems, and/or system elements described herein may be implemented using software (e.g., a computer implemented control system), such as the various embodiments of computer implemented systems described herein. The methods, steps, systems, and system elements described herein are not limited in their implementation to any specific computer system described herein, as many other different machines may be used.

S101 (Data Reception). The software component of certain embodiments described herein may include a computer program or programs that are designed to receive, record, and/or send signals to/from the electronic hardware component of the device and an external electronic device. This electronic device may be, for example, a smartphone (e.g., iPhone or Android phone), a tablet computer (e.g., iPad or Android tablet), a laptop computer, or a desktop computer. The signals may be sent via Bluetooth, wireless data (Wi-Fi), infrared signal, or another mechanism, and may be encoded as serial data.

S102 (Data Interpretation). The software component of certain embodiments described herein may also include algorithms that interpret raw data received from the sensors and translate them into information of practical use to the user, such as whether a pelvic muscle contraction has occurred, and at what strength, how many have occurred over a period of time (frequency), etc. These algorithms may include the ability to interpret the signals received from one or multiple sensors and attribute them to specific muscle groups of importance. These algorithms may also include the ability to "self-bias", that is, to identify the baseline of force, pressure, or flex upon each sensor when a contraction is not occurring.

S103 (User Interface). The user of certain embodiments described herein may control and interact with the device using a user interface program. As shown in FIGS. 14A-14E, the program may enable the user to see and/or interact with the signals (and derivations of these signals) received from the hardware. This program may include one or more of a variety of elements:

1. A method for turning on/off the sensors in the device and/or tuning their sensitivity.
2. A method for turning on/off the actuators in the device and/or tuning their strength.
3. A method for setting/adjusting actuation in the device (e.g., vibration) to help the user time their muscle contractions; such a mechanism may be set to prompt the user to contract immediately after feeling a vibration in the device.
4. A "live feed" in which the force of a given pelvic muscle contraction or collection of contractions is displayed vs. time in real time to enable the user to visualize their contractions and relaxations.
5. A display of characteristics/derivations of the data received, which may include the total number of contractions, the breakdown of contraction vs. sensor, the frequency of contraction, the duty cycle of contraction, the average force per contraction, the maximum force per contraction, etc.
6. A method for tracking progress toward achieving a specific goal. This goal may be the performing of a specific number of pelvic floor muscle contractions within a given period of time.
7. A "game" to help people engage in performing pelvic muscle contraction. This game may take a variety of forms, such as a human figure jumping over hurdles on a virtual track, or a balloon that needs to maintain flight and can only do so if the user contracts a minimum number of times within a set period of time.

S104 (Training Programs/Feedback). In some embodiments, the software component of certain embodiments described herein may include one or more training programs to educate the user on how to perform muscle contractions in order to treat a given medical or non-medical condition, including urinary incontinence, and/or sexual dysfunction. These training programs may include proactive drills/exercises matched with active feedback based on performance. These programs may include textual descriptions, images, diagrams, videos, or animations. These programs may be graded and staged such that successful completion of a given training program may unlock or advance the user to a subsequent training program.

In certain embodiments, a system for use in conducting pelvic muscle exercise described herein includes a processor adapted to be in electronic communication with the device, wherein the processor is programmed to evaluate the pelvic muscle exercise profile of the user at least in part by comparing the pelvic muscle exercise profile of the user with a baseline profile comprising force and/or pressure values as a function of time.

S105 (Network-Enabled Data Sharing). The software component of certain embodiments described herein may include a method by which the user can share information about the device with other people. Other people may include the user's physician, physical trainer, coach, friends, or network of peers. The method for sharing the data may be based on interaction with an external website, SMS (text) messaging, email messaging, etc. Data that is shared may include progress on goals associated with use of the device or ranking among peers. In one manifestation of the device, a physician, physical therapist, or a friend may maintain the ability to set the program for a user in order to guide him/her through a medically appropriate exercise regimen, and then to receive data on progress of that user through that exercise regimen.

As described herein, some embodiments are directed to a computer system including at least one processor programmed to assess or evaluate correctness of exercise profile based on a baseline profile, wherein evaluation is determined based, at least in part, on values for force and/or pressure measured by a device described herein. In some embodiments, the computer system may be implemented as an integrated system with one or more devices that determine a value or force and/or pressure as described herein. In other embodiments, the computer system may include a computer remotely located from a device, and values for one or more of force and pressure described herein may preprogrammed and/or the values may be received via a network interface communicatively coupled to a network (e.g., the Internet). The at least one processor in the computer system may be programmed to apply one or more models (e.g., baseline models/predetermined models) to received inputs to evaluate correctness of an exercise profile, as described herein.

An illustrative implementation of a computer system on which some or all of the methods described herein may be implemented may include one or more processors and one or more computer-readable (non-transitory) storage media. The processor(s) may control writing data to and reading data from the memory in any suitable manner, as the aspects described herein are not limited in this respect. It should be appreciated that the processor(s) and/or computer-readable (non-transitory) storage media may each independently be integrated into the device itself, or may be part of a separate unit adapted to be in electronic communication with the device.

To perform any of the functionality described herein, the processor(s) may execute one or more instructions, such as program modules, stored in one or more computer-readable storage media, which may serve as non-transitory computer-readable storage media storing instructions for execution by the processor. Generally, program modules include routines, programs, objects, components, data structures, etc. that perform particular tasks or implement particular abstract data types. Embodiments may also be implemented in distributed computing environments where tasks are performed by remote processing devices that are linked through a communications network. In a distributed computing environment, program modules may be located in both local and remote computer storage media including memory storage devices.

A computer may operate in a networked environment using logical connections to one or more remote computers. The one or more remote computers may include a personal computer, a cell phone, a server, a router, a network PC, a peer device or other common network node, and typically include many or all of the elements described above relative to the computer. Logical connections between a computer and the one or more remote computers may include, but are not limited to, a local area network (LAN) and a wide area network (WAN), but may also include other networks. Such networks may be based on any suitable technology and may operate according to any suitable protocol and may include wireless networks, wired networks or fiber optic networks. Such networking environments are commonplace in offices, enterprise-wide computer networks, intranets and the Internet. When used in a LAN networking environment, the computer may be connected to the LAN through a network interface or adapter. When used in a WAN networking environment, the computer typically includes a modem or other means for establishing communications over the WAN, such as the Internet. In a networked environment, program modules, or portions thereof, may be stored in the remote memory storage device.

Various inputs from a device described herein may be received by a computer 300 via a network (e.g., a LAN, a WAN, or some other network) from one or more remote devices or computers that stores data associated with the inputs. One or more of the remote devices/computers may perform analysis on remotely-stored data prior to sending analysis results as the input data to the computer. Alternatively, the remotely stored data may be sent to the computer as it was stored remotely without any remote analysis.

Various outputs described herein, including evaluations of correctness of an exercise profile (e.g., based on a baseline profile), may be provided visually on an output device (e.g., a display) connected directly to a computer or the output(s) may be provided to a remotely-located output device connected to the computer via one or more wired or wireless networks, as embodiments of the invention are not limited in this respect. Outputs described herein may additionally or alternatively be provided other than using visual presentation. For example, a computer to which an output is provided may include one or more output interfaces such as a vibratory output interfaces, for providing an indication of the output.

Anticipated Use of the Device

In certain embodiments, the device described in this application can be used for the diagnosis and treatment of urinary incontinence and other conditions described in TABLE 1. In one potential use of the device, the body portion (and/or structural manifold), or part of the body portion (and/or structural manifold) is inserted into the vagina, which brings the sensors in proximity to the muscles for the pelvic floor (FIG. 3). Contracting these muscles around the structural manifold may be measured by the device sensors (e.g., device sensors H101), whose signals are recorded by an electronics and processing unit (e.g., unit H103), which sends this information to the device software. Through interpretation and sharing of the signals recorded from the sensors, and providing feedback to the user via images, videos, diagrams, interactive games, sounds, and haptic signals (e.g., vibration), the device trains users in how to do pelvic muscle exercises correctly (with the correct intensity and the correct form), and helps users see improvement over time. In one manifestation of a device, improvement may be interpreted as a general increase in pelvic muscle strength or tone over time as recorded by the sensors, a change in the profile of response to the sensors in the device upon doing a pelvic muscle exercise, a change in response time to signals provided to the user (e.g., haptic signals such as vibration) or a change in the maximum time that one can hold a contraction of a given level.

In another possible use of the device, a patient or medical professional may use the device to record pelvic muscle strength as part of a diagnosis of a disease. TABLE 2 shows the Modified Oxford Scale for Pelvic Muscle strength, and is often used by professionals as an input/indicator for disease diagnosis. By providing a more accurate (and potentially spatially differentiated) profile of muscle strength and muscle strength over time in the vagina, and likewise, by providing a more accurate understanding of the correct form that a patient uses when attempting a pelvic muscle exercise or related pelvic-related exercise, the device may lead to more accurate and appropriate diagnosis of disease.

In another possible use of the device, the device may be used to help maintain muscle tone over time, rather than treat a condition from the start. This may be an important distinction in certain embodiments—as like all muscles, continuous training is typically required to keep pelvic muscles in shape over time. Much like a physical therapist or physical therapist can assist a patient or weight trainer in maintaining muscle strength over time, this invention, by feedback on intensity and form of exercise, can be useful in enabling users to better maintain pelvic muscle strength and capability over time.

In another possible use of the device, the body portion (and/or structural manifold) or part of the body portion (and/or structural manifold) is inserted into the anus, which brings the sensors in proximity to the muscles for the pelvic floor. Contracting these muscles (which can include the anal sphincter) around the structural manifold is measured by the device sensors (e.g., sensors H101), whose signals are recorded by the electronics and processing unit (e.g., unit H103), which sends this information to the device software. Through interpretation and sharing of the signals recorded from the sensors, and providing feedback to the user via images, videos, diagrams, interactive games, sounds, and haptic signals (e.g., vibration), the device trains users in how to do pelvic muscle exercises correctly (with the correct intensity and the correct form), and helps users see improvement over time. This use of the device may be especially appropriate for the treatment of men for incontinence and other conditions from TABLE 1, and for fecal incontinence in men and women.

TABLE 1

| Conditions Treatable Through Pelvic Muscle Exercise* | ICD-9 Code |
|---|---|
| Female Sexual Dysfunction | 302.72 |
| Male Premature Ejaculation | 302.75 |
| Interstitial Cystitis/Painful Bladder Syndrome | 595.1 |
| Vaginal Prolapse | 618 |
| Uterine Prolapse | 618.1 |
| Dyspareunia (Pain During Sex) | 625 |
| Stress Incontinence, Female | 625.6 |
| Vulvar/Pelvic Pain/Vulvodynia/Vestibulodynia | 625.9 |
| Pain in the Pelvic Region | 719.45 |

TABLE 1-continued

| Conditions Treatable Through Pelvic Muscle Exercise* | ICD-9 Code |
|---|---|
| Pelvic Floor Dysfunction | 739.5 |
| Fecal Incontinence | 787.6 |
| Urge Incontinence/Overactive Bladder | 788.31 |
| Stress Incontinence, Male | 788.32 |
| Mixed Incontinence | 788.33 |
| Continuous Leakage | 788.37 |
| High Urinary Frequency | 788.41 |
| Polyuria | 788.42 |
| Pre-Childbirth Preparation/Stretching | Various |
| Post-Childbirth Recovery | Various |

*Not an exhaustive/complete list

TABLE 2

| Grade | Modified Oxford Scale |
|---|---|
| 0 | Lack of muscle response |
| 1 | Flicker of non-sustained contraction |
| 2 | Presence of low intensity, but sustained contraction |
| 3 | Moderate contraction, feels like an increase in intravaginal pressure, which compresses with the fingers of the examiner with small cranial elevation of the vaginal wall |

TABLE 2-continued

| Grade | Modified Oxford Scale |
|---|---|
| 4 | Satisfactory compression, compressing the fingers of examiner with elevation of the vaginal wall towards the pubic symphysis |
| 5 | Strong contraction, firm compression of the examiner's fingers with positive movement toward the pubic symphysis |

Further explanation of the grades/levels described in this scale is provided in H. Talasz et. al. *Int Urogynecol J* 2008: "Grade 0 describes the complete lack of any discernible response in the perivaginal muscles, and Grade 1 corresponds to a minor fluttering of the muscles ("nonfunctioning" PFM according to the definition of the International Continence Society) Grade 2 means a weak muscle activity without a circular contraction, squeeze, or inward movement of the vagina ("underactive" PFM according to the definition of the ICS). Grade 3 describes a reproducible muscle contraction with moderate circular squeeze pressure around the examiner's finger and with an elevation and cranioventral displacement of the vagina ("normal" PFM contraction according to the definition of the ICS). Grades 4 and 5 describe a good or a strong muscle contraction even against a resistance by the examining finger and a significant inward movement of the vagina ("strong" PFM contraction according to the definition of the ICS)."

TABLE 3

| Sensor Type | Manufacturer | Part No. | Description | Cost per unit at 1,000 units (Digikey Inc.) |
|---|---|---|---|---|
| Force Sensitive Resistor | Interlink Electronics | 30-81794 | FLAT MEMBRANE RESISTIVE FORCE SENSOR FSR402 0.5" CIRC W/TAB | <$0.50* |
| Force Sensitive Resistor | Interlink Electronics | 30-73258 | FLAT MEMBRANE RESISTIVE FORCE SENSOR FSR406 1.5" SQ W/TAB | <$0.50* |
| Force Sensitive Resistor | Interlink Electronics | 30-61710 | FLAT MEMBRANE RESISTIVE FORCE SENSOR FSR408 24" STRIP W/TAB | <$0.50* |
| IC MEMS Pressure Sensor | STMicroelectronics | LPS25HTR | IC MEMS PRESSURE SENSOR 10HCLGA, DIGITAL OUTPUT | $2.43 |
| IC MEMS Pressure Sensor | STMicroelectronics | LPS331APTR | IC PRESSURE SENSOR PIEZO 16HCLGA DIGITAL OUTPUT ABSOLUTE | $2.49 |
| IC MEMS Pressure Sensor | Bosch Sensortec | BMP180 | IC BAROMETRIC PRESSURE SENSOR 7-VLGA I2C DIGITAL OUTPUT | $4.80 |
| IC MEMS Pressure Sensor | Bosch Sensortec | BMP085 | IC BAROMETRIC PRESSURE SENSOR 8-CLCC I2C DIGITAL OUTPUT | $9.99 |
| IC MEMS Barometer | Freescale Semiconductor | MPL115A2 | IC BAROMETER MINI 8LGA I2C DIGITAL OUTPUT ABSOLUTE PRESSURE | $3.48 |
| IC MEMS Barometer | Freescale Semiconductor | MPL115A1 | IC BAROMETER MINI 8LGA SPI DIGITAL OUTPUT ABSOLUTE PRESSURE | $3.48 |
| IC MEMS Barometer | Freescale Semiconductor | MP3H6115A6U | IC PRESSURE SENSOR PIEZO 8SSOP ANALOG OUTPUT ABSOLUTE PRESSURE SENSOR 4SMD | $8.02 |
| IC MEMS Barometer | Epcos | B58620S3300B360 | MODULE ANALOG OUTPUT ABSOLUTE PRESSURE (RANGE: 20-120 | $11.25 |

*Quote from Manufacturer

TABLE 4

| Material | Manufacturer | Chemical Composition | Young's Modulus (MPa) |
|---|---|---|---|
| Sylgard 184 | Dow Corning | PDMS | 2.5 |
| RTV-615 | GE Silicones | PDMS | 0.8 |
| VDT-731 + HMS-301 | Gelest | hPDMS | 8.2 |
| RMS-033 | Gelest | sPDMS | 0.6 |
| Ecoflex ® Supersoft 5 | Smooth-On | PSR | 0.6 |
| Ecoflex ® Supersoft 0010 | Smooth-On | PSR | 2.2 |
| Ecoflex ® Supersoft 0020 | Smooth-On | PSR | 2.7 |
| Ecoflex ® Supersoft 0030 | Smooth-On | PSR | 3.5 |
| Ecoflex ® Supersoft 0050 | Smooth-On | PSR | 5.5 |
| DragonSkin 10 | Smooth-On | PSR | 0.7 |
| DragonSkin 20 | Smooth-On | PSR | 0.8 |
| DragonSkin 30 | Smooth-On | PSR | 1.1 |
| Equinox ® 35 | Smooth-On | PSRP | 1.2 |
| Equinox ® 38 | Smooth-On | PSRP | 1.3 |
| Equinox ® 40 | Smooth-On | PSRP | 1.4 |

PDMS: Poly(dimethylsiloxane)
hPDMS: "Hard" poly(dimethylsiloxane)
sPDMS: "Soft" poly(dimethylsiloxane)
PSR: Platinum-Catalyzed Silicone Rubber
PSRP: Platinum-Catalyzed Silicone Rubber Putty

What is claimed is:

1. A device for use in conducting pelvic muscle exercise, comprising:

a body portion comprising a first portion, a second portion, and an intermediary portion between the first and second portions, wherein the body portion comprises a flexible polymeric material;

a sensor, wherein at least a portion of the sensor is embedded in the flexible polymeric material and is positioned at an interior of the body portion such that the sensor is sealed from an environment exterior to the body portion, and wherein the sensor is constructed and arranged to measure a force or pressure applied to the body portion, wherein the device is constructed and arranged to determine a position, at a surface of the body portion, and an intensity, of a force and/or a pressure applied to the body portion, and to determine a correct or desired form of the pelvic muscle exercise conducted by a user, and to compare a pelvic muscle exercise profile of the user with a baseline profile comprising force and/or pressure values as a function of time and position relative to the first and second portions of the body portion of the device.

2. The device of claim 1, wherein the pressure is at least 15 kPa.

3. The device of claim 1, wherein the pressure is less than or equal to 126 kPa.

4. The device of claim 1, wherein the force is at least 0.1 N.

5. The device of claim 1, wherein the force is less than or equal to 100 N.

6. The device of claim 1, wherein the force is an anisotropic force, wherein the anisotropic force has a component normal to the surface of the body portion, and wherein the component of force normal to a surface of the body portion is at least 0.1 N and/or less than or equal to 100 N.

7. The device of claim 1, wherein the first portion is a first end of the device, and the second portion is a second end of the device.

8. The device of claim 7, wherein the sensor is positioned at the first or second portions.

9. The device of claim 1, wherein the position is relative to a position on a perimeter of a cross-section of the body portion.

10. The device of claim 1, wherein the sensor is an impedance sensor, a voltage sensor, or a current sensor.

11. The device of claim 1, wherein the sensor is positioned along the body portion between the first and second portions.

12. The device of claim 1, wherein the flexible polymeric material is an elastomer.

13. The device of claim 1, wherein the flexible polymeric material has a Young's modulus of at least 0.6 MPa and/or less than or equal to 5.5 MPa.

14. The device claim 1, wherein the device has an average length of at least 1 cm and less than or equal to 10 cm.

15. The device claim 1, wherein the device has an average diameter or cross-section of at least 0.1 cm and less than or equal to 5 cm.

16. The device of claim 1, wherein the device comprises at least two sensors.

17. The device of claim 1, wherein the device comprises at least two sensors positioned in series along a length of the body portion of the device.

18. The device of claim 1, wherein the device comprises at least two sensors positioned around a perimeter or circumference of the body portion of the device.

19. The device of claim 1, wherein the device comprises an actuator.

20. The device of claim 1, wherein the device comprises a handle.

21. The device of claim 1, wherein the device comprises one or more cavities containing a fluid.

22. The device of claim 21, wherein the one or more cavities comprises a foam that comprises the fluid.

23. The device of claim 21, wherein the fluid is a gas.

24. The device of claim 21, wherein the fluid is a liquid.

25. The device of claim 1, wherein the sensor is mounted on a hard central manifold.

26. The device of claim 1, wherein the sensor is embedded in the flexible polymeric material such that the flexible polymeric material redistributes and/or dampens a force or pressure applied to the body portion.

27. A device for use in conducting pelvic muscle exercise, comprising:

a body portion comprising a first portion, a second portion, and an intermediary portion between the first and second portions, wherein the body portion comprises a flexible polymeric material;

a sensor, wherein at least a portion of the sensor is embedded in the flexible polymeric material and is positioned at an interior of the body portion such that the sensor is sealed from an environment exterior to the body portion, and wherein the sensor is constructed and arranged to measure a force or pressure applied to the body portion; and a cavity containing a fluid positioned between the sensor and a surface of the body portion, wherein at least a portion of the sensor is positioned within the cavity, wherein the device is constructed and arranged to determine a position, at a surface of the body portion, of a force and/or a pressure applied to the body portion, and to compare a pelvic muscle exercise profile of the user with a baseline profile comprising force and/or pressure values as a function of time and position relative to the first and second portions of the body portion of the device.

28. A system for use in conducting pelvic muscle exercise, comprising:

a device comprising:

a body portion comprising a first portion, a second portion, and an intermediary portion between the first and second portions, wherein the body portion comprises a flexible polymeric material; and a sensor, wherein at least a portion of the sensor is embedded in the flexible polymeric material and is positioned at an interior of the body portion such that the sensor is sealed from an environment exterior to the body portion, and wherein the sensor is constructed and arranged to measure a force or a pressure applied to a surface of the body wherein the device is constructed and arranged to determine a position, at a surface of the body portion, of a force and/or a pressure applied to the body portion; and a processor adapted to be in electronic communication with the device, wherein the processor is programmed to evaluate a pelvic muscle exercise profile of a user at least in part by comparing the pelvic muscle exercise profile of the user with a baseline profile comprising force and/or pressure values as a function of time and as a function of position relative to the first and second portions of the body portion of the device, and wherein the baseline profile indicates a correct or desired profile of exercise to be followed by the user.

29. A system for use in conducting pelvic muscle exercise, comprising:

a device comprising:

a body portion comprising a first portion, a second portion, and an intermediary portion between the first and second portions, wherein the body portion comprises a flexible polymeric material; and a sensor, wherein at least a portion of the sensor is embedded in the flexible polymeric material and is positioned at an interior of the body portion such that the sensor is sealed from an environment exterior to the body portion, and wherein the sensor is constructed and arranged to measure a force or pressure applied to the body portion, wherein the device is constructed and arranged to generate two or more signals simultaneously as a result of a single act of a user which applies the force or pressure to the body portion, each signal comprising intensity of force or pressure as a function of time, wherein the two or more signals indicate a correct or desired profile of exercise to be followed by the user; and wherein the device is constructed and arranged to determine a position, at a surface of the body portion, of a force and/or a pressure applied to the body portion and to compare a pelvic muscle exercise profile of the user with a baseline profile comprising force and/or pressure values as a function of time and position relative to the first and second portions of the body portion of the device.

30. The system of claim 29, wherein the two or more signals comprise intensity of force or pressure as a function of time that are measured at two or more positions along the surface of the body portion of the device.

31. The system of claim 29, wherein the sensor is constructed and arranged to measure the force or a pressure applied to the body portion at two or more positions along the surface of the body portion.

32. A system for use in conducting pelvic muscle exercise, comprising:

a device comprising:

a body portion comprising a first portion, a second portion, and an intermediary portion between the first and second portions; and a sensor, wherein at least a portion of the sensor is embedded in a flexible polymeric material and is positioned at an interior of the body portion such that the sensor is sealed from an environment exterior to the body portion, and wherein the sensor is constructed and arranged to measure a force or pressure applied to the body portion;

wherein the device is constructed and arranged to determine a position, at a surface of the body portion; and a computer-readable storage medium encoded with a plurality of instructions that, when executed by a computer, performs a method for evaluating a pelvic muscle exercise profile of a user, wherein the method comprises:

receiving information for a pelvic muscle exercise profile of a user, wherein the pelvic muscle exercise profile of the user comprises force and/or pressure values as a function of time; and evaluating, using at least one processor, the pelvic muscle exercise profile of the user at least in part by comparing the pelvic muscle exercise profile of the user with a baseline profile comprising force and/or pressure values as a function of time and position relative to the first and second portions of the body portion of the device, wherein the baseline profile indicates a correct or desired profile of exercise to be followed by the user.

33. A method of evaluating a pelvic muscle exercise profile of a user, comprising:

receiving information for a pelvic muscle exercise profile of a user from a device for use in conducting pelvic muscle exercise, wherein the pelvic muscle exercise profile of the user comprises force and/or pressure values as a function of time, and wherein the device comprises:

a body portion comprising a first portion, a second portion, and an intermediary portion between the first and second portions, wherein the body portion comprises a flexible polymeric material; and a sensor, wherein at least a portion of the sensor is embedded in the flexible polymeric material and is positioned at an interior of the body portion such that the sensor is sealed from an environment exterior to the body portion;

wherein the device is constructed and arranged to determine a position, at a surface of the body portion; and evaluating, using at least one processor, the pelvic muscle exercise profile of the user at least in part by comparing the pelvic muscle exercise profile of the user with a baseline profile comprising force and/or pressure values as a function of time and position relative to the first and second portions of the body portion of the device, wherein the baseline profile indicates a correct or desired profile of exercise to be followed by the user.

* * * * *